US007396627B2

(12) United States Patent
Watanabe et al.

(10) Patent No.: US 7,396,627 B2
(45) Date of Patent: Jul. 8, 2008

(54) METHOD OF PREPARING A TONER, DEVELOPER INCLUDING THE TONER, CONTAINER CONTAINING THE TONER, AND IMAGE FORMING METHOD AND PROCESS CARTRIDGE USING THE TONER

(75) Inventors: Naohiro Watanabe, Shizuoka-ken (JP); Chiaki Tanaka, Shizuoka-ken (JP); Masayuki Ishii, Shizuoka-ken (JP); Kei Naitoh, Shizuoka-ken (JP); Takuya Saito, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 419 days.

(21) Appl. No.: 11/149,246

(22) Filed: Jun. 10, 2005

(65) Prior Publication Data

US 2005/0277044 A1 Dec. 15, 2005

(30) Foreign Application Priority Data

Jun. 15, 2004 (JP) ..... 2004-177109

(51) Int. Cl.
*G03G 9/00* (2006.01)

(52) U.S. Cl. ..... 430/109.3; 430/124.1; 430/137.1; 430/137.14; 430/137.15

(58) Field of Classification Search ..... 430/109.3, 430/124.1, 137.1, 137.14, 137.15
See application file for complete search history.

(56) References Cited

U.S. PATENT DOCUMENTS 4,071,670 A 1/1978 Vanzo et al.
5,552,502 A * 9/1996 Odell et al. ..... 526/234
5,688,870 A * 11/1997 Wilkinson et al. ..... 525/244

FOREIGN PATENT DOCUMENTS

| | | |
|---|---|---|
| JP | 36-10231 | 7/1961 |
| JP | 47-51830 | 12/1972 |
| JP | 51-14895 | 5/1976 |
| JP | 53-17735 | 2/1978 |
| JP | 53-17736 | 2/1978 |
| JP | 53-17737 | 2/1978 |
| JP | 60-090344 | 5/1985 |
| JP | 62-063940 | 3/1987 |
| JP | 63-186253 | 8/1988 |
| JP | 64-015755 | 1/1989 |
| JP | 02-082267 | 3/1990 |
| JP | 03-041470 | 2/1991 |
| JP | 03-229264 | 10/1991 |
| JP | 04-306664 | 10/1992 |
| JP | 05-181315 | 7/1993 |

(Continued)

OTHER PUBLICATIONS

U.S. Appl. No. 11/522,936, filed Sep. 19, 2006, Ishii et al.

(Continued)

*Primary Examiner*—Mark A Chapman
(74) *Attorney, Agent, or Firm*—Oblon, Spivak, McClelland, Maier & Neustadt, P.C.

(57) ABSTRACT

A method including contacting a toner including:

a binder resin including an unsaturated carboxylic acid derivative monomer;

a vinyl polymerizing monomer; and a colorant;

to a supercritical fluid or a sub-critical fluid to remove the unsaturated carboxylic acid derivative monomer.

35 Claims, 9 Drawing Sheets

FOREIGN PATENT DOCUMENTS

| | | |
|---|---|---|
| JP | 05-265252 | 10/1993 |
| JP | 06-329947 | 11/1994 |
| JP | 07-092731 | 4/1995 |
| JP | 08-160660 | 6/1996 |
| JP | 09-015904 | 1/1997 |
| JP | 11-249339 | 9/1999 |
| JP | 11-305486 | 11/1999 |
| JP | 2001-022117 | 1/2001 |

OTHER PUBLICATIONS

U.S. Appl. No. 11/513,175, filed Aug. 31, 2006, Ohki et al.
U.S. Appl. No. 11/519,893, filed Sep. 13, 2006, Inoue et al.
U.S. Appl. No. 11/685,872, filed Mar. 14, 2007, Uchinokura et al.
U.S. Appl. No. 11/687,372, filed Mar. 16, 2007, Yamada et al.
U.S. Appl. No. 11/685,969, filed Mar. 14, 2007, Uchinokura et al.
U.S. Appl. No. 11/852,778, filed Sep. 10, 2007, Nagatomo et al.
U.S. Appl. No. 11/857,791, filed Sep. 19, 2007, Kojima et al.

* cited by examiner

METHOD OF PREPARING A TONER, DEVELOPER INCLUDING THE TONER, CONTAINER CONTAINING THE TONER, AND IMAGE FORMING METHOD AND PROCESS CARTRIDGE USING THE TONER

BACKGROUND OF THE INVENTION

1. Field of the Invention

The present invention relates to a method of preparing a toner for use in electrophotographic methods, electrostatic recording methods and electrostatic printing methods.

2. Discussion of the Background

The electrophotographic image forming method typically includes forming an electrostatic latent image on a photoreceptor (an electrostatic latent image bearer); developing the electrostatic latent image with a developer including a toner to form a visible image (a toner image); and transferring and fixing the visible image onto an image support (transfer material) such as a paper. A heat roller fixing method directly contacting a heating roller to the toner image upon application of pressure and fixing the toner image on the transfer material is widely used because the method has good heat efficiency and the heating roller can be downsized.

However, the heat roller fixing method consumes a large amount of electric power, and various methods of reducing the electric power consumption in terms of saving energy. For instance, it is suggested that a layer of the heating roller, contacting the toner image transferred onto the transfer material, should be as thin as possible to increase the heat energy efficiency and largely shorten a warm-up time thereof. However, in this case, the heating roller has a smaller specific heat capacity, and a difference of temperature between a part the transfer material passes and a part the transfer material does not pass thereof becomes large. Therefore, a melted toner adheres thereto, and after the heating roller makes one revolution, the melted toner adheres to a part of the transfer material, having no image, i.e., the hot offset problem tends to occur. On the other hand, controlling a heat characteristic of a binder resin in the toner is also studied to increase the heat energy efficiency. However, when a glass transition temperature (Tg) of the binder resin is reduced, thermostability of the resultant toner possibly deteriorates. When a molecular weight thereof is reduced, the offset phenomenon tends to occur. Therefore, a toner having good low-temperature fixability and less hot offset problem is not provided yet.

A technology procurement project of copiers for the next generation is present in DSM (Demand-side-Management) programs of International Energy Agency (IEA) in 1999, wherein copiers producing 30 cpm or more are required to have the standby period not greater than 10 sec and electricity consumption of from 10 to 30 W (dependent on copy speed), which will infinitely save more energy than conventional copiers, and saving energy is quite an important subject.

Various suggestions have been made for saving energy, e.g., Japanese Laid-Open Patent Publications Nos. 60-90344, 64-15755, 2-82267, 3-229264, 3-41470 and 11-305486 disclose a method of replacing a styrene-acrylic resin frequently used as a binder resin with a polyester resin having good low-temperature fixability and comparatively good thermostability for the purpose of reducing the fixable temperature of a toner. Japanese Laid-Open Patent Publication No. 62-63940 discloses a method of including a specific non-olefin crystalline polymer in a binder resin for the purpose of improving the low-temperature fixability of a toner. Japanese Patent No. 2931899 discloses a method of using a crystalline polyester as a binder resin.

However, these methods wherein a molecular structure and a molecular weight are not optimized have difficulty in achieving the required specification in the DSM (Demand-side-Management) programs of International Energy Agency (IEA).

By the way, methods of preparing a toner are broadly classified into a pulverization method and a suspension polymerization method.

The pulverization method includes kneading a colorant, a charge controlling agent and the like in a binder resin upon application of heat, uniformly dispersing them therein to prepare toner constituents, and pulverizing and classifying the toner constituents to prepare a toner. However, the pulverization method needs a pulverizer pulverizing the toner constituents, which is costly and inefficient. In addition, the pulverized toner tends to have a wide particle diameter distribution, and for example, fine particles having a diameter not greater than 5 μm and coarse particles having a diameter not less than 20 μm have to be removed to produce images having good image resolution and tone reproduction, and therefore a yield extremely decreases. In addition, it is difficult to uniformly disperse the colorant, charge controlling agent and the like in the thermoplastic resin by the pulverization method. Nonuniform dispersion thereof adversely affects fluidity, developability and durability of the resultant toner and image quality produced thereby.

The suspension polymerization method prepares a toner by suspending and polymerizing the toner constituents in water. Although the suspension polymerization method solves the problems of the pulverization method, the suspension polymerization method has the following problems. Namely, an unsaturated carboxylic acid derivative monomer is included in the toner constituents for the purpose of improving chargeability and controlling glass transition temperature of the resultant toner. However, practically, the monomer cannot completely be reacted in the process of polymerization, and a small amount thereof remains in the resultant toner. Having a high polarity, the unsaturated carboxylic acid derivative monomer cannot completely be removed from the toner under reduced pressure or with a solvent which does not dissolve the toner. When the unsaturated carboxylic acid derivative monomer remains in a toner, the charged stability of the resultant toner deteriorates and charge quantity thereof widens because the unsaturated carboxylic acid derivative monomer has a high hygroscopicity. The toner produces images having background fouling, and contaminates a photoreceptor, a charging roller and a developing roller.

Japanese Patent No. 2537503 and Japanese Laid-Open Patent Publication No. 2001-22117 disclose an emulsification polymerization method of preparing amorphous toner particles by assembling a particulate resin. The particulate resin includes a carboxylic acid group for the purpose of controlling the assembly. The unsaturated carboxylic acid derivative monomer is included in the process of polymerizing the particulate resin to include a carboxylic acid group therein. Similarly to the suspension polymerization method, a small amount of the unsaturated carboxylic acid derivative monomer remains in a toner, and the charged stability of the resultant toner deteriorates and charge quantity thereof widens. Further, the toner produces images having background fouling, and contaminates a photoreceptor, a charging roller and a developing roller.

Because of these reasons, a need exists for a method of preparing a toner having good chargeability, fluidity and transferability without being influenced by the environment, which produces high quality images.

SUMMARY OF THE INVENTION

Accordingly, an object of the present invention is to provide a method of preparing a toner having good chargeability, fluidity and transferability without being influenced by the environment, which produces high quality images.

Another object of the present invention is to provide a developer including the toner.

A further object of the present invention is to provide a container containing the toner.

Another object of the present invention is to provide an image forming method using the toner.

A further object of the present invention is to provide a process cartridge using the toner.

These objects and other objects of the present invention, either individually or collectively, have been satisfied by the discovery of a method of producing a toner, comprising:

preparing a toner comprising:

a binder resin comprising:

an unsaturated carboxylic acid derivative monomer, and a vinyl polymerizing monomer; and a colorant; and contacting the toner to at least one of a supercritical fluid and a sub-critical fluid to remove the unsaturated carboxylic acid derivative monomer.

The unsaturated carboxylic acid derivative monomer is preferably an unsaturated carboxylic acid monomer.

Further, the vinyl polymerizing monomer is preferably an aromatic vinyl polymerizing monomer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
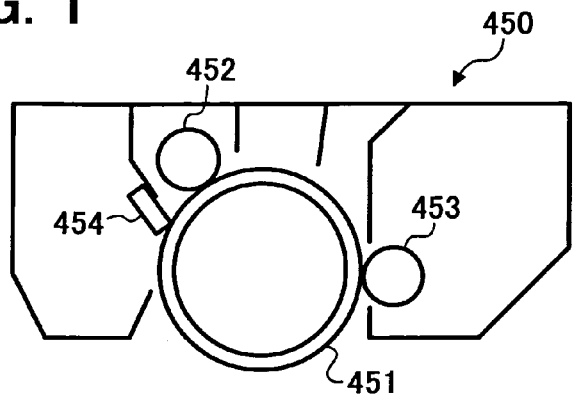
FIG. 1 is a schematic view illustrating an embodiment of the process cartridge of the present invention.

The present invention provides a method of preparing a toner having good chargeability, fluidity and transferability without being influenced by the environment, which produces high quality images. In a preferred embodiment the invention comprises:

contacting a toner comprising a binder resin that comprises polymerized units of at least one unsaturated carboxylic acid monomer with at least one of a supercritical fluid and a sub-critical fluid to remove unpolymerized unsaturated carboxylic acid monomer.

The unsaturated carboxylic acid derivative monomer removal process is a process of removing the unsaturated carboxylic acid derivative monomer present in a toner and/or thereon, using at least one of a supercritical fluid or a sub-critical fluid.

The toner is not particularly limited, and can be selected in accordance with the intended use. The toner is preferably prepared by a process of forming particles, mentioned later, however a commercial toner can be used.

The unsaturated carboxylic acid derivative monomer includes compounds having the following formula (i):

$$H_2C{=}CR^1COOH \qquad \text{(i)}$$

wherein $R^1$ represents a hydrogen atom or a hydrocarbon group having 1 to 10 carbon atoms.

Specific examples thereof typically include an acrylic acid and a methacrylic acid, and include addition polymerizing unsaturated fatty monocarboxylic acids such as an α-ethylacrylic acid, a crotonic acid, an α-methyl crotonic acid, an α-ethyl crotonic acid, an isocrotonic acid and a tiglic acid; and addition polymerizing unsaturated fatty dicarboxylic acids and their esters such as a maleic acid, a fumaric acid, an itaconic acid, a citraconic acid, a mesaconic acid, a glutaconic acid and a dihydro muconic acid.

A toner preferably includes the unsaturated carboxylic acid derivative monomer in an amount of from 0.05 to 10% by weight, and more preferably from 0.1 to 5% by weight.

The supercritical fluid is not particularly limited, provided being present as a noncondensable high-density fluid at a temperature and a pressure over a limit (critical point) where a gas and a liquid can coexist, and can be selected in accordance with the purpose and preferably has a low critical temperature. The sub-critical fluid is not particularly limited, provided being present as a liquid at high pressure at a temperature and a pressure close to the critical point, and can be selected in accordance with the purpose. Specific examples of the fluid include, but are not limited to, carbon monoxide, carbon dioxide, ammonia, nitrogen, water, methanol, ethanol, ethane propane, 2,3-dimethyl butane, benzene, chlorotrifluoromethane and dimethyl ether. Among these fluids, the carbon dioxide is most preferably used because of having a low critical temperature about 31.3° C. and being easy to use.

The supercritical fluids and sub-critical fluids can be used alone or in combination.

It is preferable that the supercritical fluids and sub-critical fluids do not dissolve a toner, and dissolve the unsaturated carboxylic acid derivative monomer.

The critical temperature and pressure are not particularly limited, and can be selected in accordance with the purpose. The critical temperature is preferably from −273 to 300° C., and more preferably from 0 to 200° C., and then the critical pressure is preferably from 1 to 60 Mpa.

In addition to the supercritical fluids and sub-critical fluids, the other fluids can be used in combination. The other fluids are preferably has a high affinity for a material to be removed, having a low melting point (a chain transfer agent) When a toner has a core shell structure, the other fluids preferably do not dissolve materials forming the shell. Specific examples of the other fluids include, but are not limited to, nitric monoxide, ethane, propane and ethylene.

A mixing ratio of the other fluid to the supercritical fluid or sub-critical fluid is not particularly limited, and can be selected in accordance with the purpose.

Further, in addition to the supercritical fluid and sub-critical fluid, an organic solvent can be used in combination. The unsaturated carboxylic acid derivative monomer can more easily be removed in combination therewith.

The organic solvent is not particularly limited, and can be selected in accordance with the purpose. Specific examples thereof include, but are not limited to, methanol, ammonia, melamine, urea and thiodiethylene glycol. Particularly, a removal auxiliary agent such as chloroform having a high polymerizing monomer solubility is preferably used. The chloroform increases an effect of removing the unsaturated carboxylic acid derivative monomer.

The organic solvent is preferably included in the supercritical fluid or sub-critical fluid in an amount of 0.001 to 5% by weight based on total weight of the supercritical fluid or sub-critical fluid and the organic solvent.

At least the unsaturated carboxylic acid derivative monomer present on the surface of a toner is removed.

The unsaturated carboxylic acid derivative monomer at not only a part of the toner but also the unsaturated carboxylic acid derivative monomer at an inside thereof is preferably removed, because when the unsaturated carboxylic acid derivative monomer at an inside thereof is removed, the unsaturated carboxylic acid derivative monomer present on the surface thereof can also be removed.

The temperature, the pressure or the supercritical fluid are changed to change a part where the unsaturated carboxylic acid derivative monomer is removed.

A method of removing the unsaturated carboxylic acid derivative monomer is not particularly limited, provided that at least either the supercritical fluid or the sub-critical fluid is contacted to a toner, and can be selected in accordance with the purpose.

An apparatus for removing the unsaturated carboxylic acid derivative monomer is not particularly limited, and can be selected in accordance with the purpose. However, the apparatus preferably includes a pressure-resistant container wherein the unsaturated carboxylic acid derivative monomer is removed from a toner; a pressure pump supplying the supercritical fluid; and separation tank having a depressure valve, wherein a gas including a release agent, which is removed from the toner, is separated into the release agent and a solvent.

The method of removing the unsaturated carboxylic acid derivative monomer includes placing a toner in the pressure-resistant container; supplying the supercritical fluid or sub-critical fluid therein with the pressure pump to contact the supercritical fluid or sub-critical fluid to the toner to remove the unsaturated carboxylic acid derivative monomer therefrom; and discharging the fluid including the unsaturated carboxylic acid derivative monomer. Then, the supercritical fluid or sub-critical fluid returned in an environment of a normal temperature and a normal pressure becomes a gas. Therefore, a solvent need not be removed and wastewater after washing the surface of a toner is not discharged, which lessens the environment load.

Then, the fluid including the unsaturated carboxylic acid derivative monomer is depressurized in the separation tank to separate the fluid and the unsaturated carboxylic acid derivative monomer, and the fluid may be recycled.

The removal temperature is not particularly limited, provided that the temperature is not less than a critical temperature of the supercritical fluid or sub-critical fluid, and can be selected in accordance with the purpose. A maximum thereof is preferably not greater than a melting point of constituents of the toner, and a temperature at which the toner does not agglutinate. A minimum thereof is preferably a temperature at which the other fluids usable therewith can be present as a gas.

Specifically, the removal temperature is preferably from 0 to 100° C., more preferably from 20 to 80° C., and even more preferably from 4 to 60° C. When lower than 4° C., it is difficult to remove water absorbed in the surface of a toner. When higher than 60° C., the toner occasionally dissolves.

As mentioned above, the unsaturated carboxylic acid derivative monomer is removed with at least either the supercritical fluid or sub-critical fluid.

The toner is not particularly limited, and can be selected from known toners in accordance with the purpose, such as a pulverized toner, a polymerized toner and a microencapsulated toner by a spray dry method or a coacervation method. The polymerized toner preferably used in the present invention will be explained.

The polymerized toner is not particularly limited, and can be selected in accordance with the purpose. The polymerized toner is typically prepared by an emulsification coagulation method wherein a polymerizing monomer including at least the unsaturated carboxylic acid derivative monomer is emulsification polymerized or mini-emulsion polymerized in an aqueous medium in the presence of a polymerization initiator to prepare polymerized particles, and the particles are coagulated or fusion bonded therein; a suspension polymerization method wherein a polymerizing mixture including at least the unsaturated carboxylic acid derivative monomer and a polymerization initiator is put in an aqueous medium including a suspension stabilizer, and the mixture is stirred therein to prepare polymerized particles; and a dispersion polymerization method wherein a liquid mixture including a hydrophilic organic liquid and a polymer dispersant soluble therein is prepared, and a polymerizing monomer including at least the unsaturated carboxylic acid derivative monomer soluble therein, but the polymerized product is hardly soluble and swells therein, is added in the liquid mixture to prepare polymerized particles. In addition, it is preferable that the toner optionally includes a colorant, a release agent, an inorganic particulate material, a charge controlling agent, a polymerized particulate material, a fluidity improver, a cleanability improver, a magnetic material, etc.

Specific examples of the polymerization initiator include azo-type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; organic peroxide-type polymerization initiators such as benzoylperoxide, lauroylperoxide, di-α-cumylperoxide, 2,5-dimethyl2,5-bis(benzoylperoxy)hexane, bis(4-tert-butylcyclohexyl)peroxydicarbonate, 1,1-bis(tert-butylperoxy)cyclododecane,
tert-butylperoxymaleic acid,
bis(tert-butylperoxy)isophthalate, methyl ethyl ketone peroxide, tert-butylperoxy-2-ethylhexanoate,
diisopropylperoxycarbonate, cumenehydroperoxide, and 2,4-dichlorobenzoylperoxide; redox initiators such as combinations of oxidizing materials (e.g., inorganic peroxides such as hydrogen peroxide, persulfates (sodium salts, potassium salts, ammonium salts, etc.), oxidizing metal salts such as tetravalent cerium salts) and reducing materials such as amino compounds (e.g., ammonia, lower amines (such as amines having 1 to about 6 carbon atoms, for example, methyl amine and ethyl amine), and hydroxylamines), reducing sulfur-containing compounds (e.g., sodium thiosulfate, sodium hydrogen sulfite, sodium sulfite, and sodium formaldehyde sulfoxylate), and other reducing materials (such as lower alcohols having 1 to about 6 carbon atoms, ascorbinic acid and its salts, and lower aldehydes having 1 to about 6 carbon atoms); etc.

The initiators are selected with reference to their 10 hour half life temperature, and can be used alone or in combination. An addition quantity of the polymerization initiator depends on a desired degree of polymerization, and is typically and preferably from 0.1 to 20% by weight, and more preferably from 0.5 to 5% by weight based on total weight of the polymerizing monomer.

Suitable polymerizable monomers for use in the polymerizing mixture include radically polymerizable vinyl monomers including monofunctional polymerizable monomers and polyfunctional polymerizable monomers.

Specific examples of the monofunctional polymerizable monomers include styrene derivatives such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic monomers such as methylacrylate, ethyl acrylate, n-propyl acrylate, iso-propyl acrylate, n-butyl acrylate, iso-butyl acrylate, tert-butyl acryalte, n-amyl acrylate, n-hexyl acrylate, 2-ethylhexyl acryalte, n-octyl acryalte, n-nonyl acrylate, cyclohexyl acrylate, benzyl acryalte, dimethylphosphate ethyl acylate, diethylphosphate ethyl acylate, dibutylphosphate ethyl acylate, and 2-benzoyloxyethyl acrylate; methacrylic monomers such as methyl methacrylate, ethyl methacrylate, n-propyl methacrylate, iso-propyl methacrylate, n-butyl methacrylate, iso-butyl methacrylate, tert-butyl methacryalte, n-amyl methacrylate, n-hexyl methacrylate, 2-ethylhexyl methacryalte, n-octyl methacryalte, n-nonyl methacrylate, diethylphosphate ethyl methacylate, dibutylphosphate ethyl methacylate; vinyl esters such as methylenealiphaticmonocarboxylic acid esters, vinyl acetate, vinyl propionate, vinyl butyrate, vinyl benzoate, vinyl formate; vinyl ethers such as vinyl methyl ether, vinyl ethyl ether, and vinyl isobutyl ether; vinyl ketones such as vinyl methyl ketone, vinyl hexyl ketone, and vinyl isopropyl ketone; etc.

Specific examples of the polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis{4-(acryloxydiethoxy) phenyl}propane, trimethylolpropane triacrylate, tetramethylolmethane tetraacrylate, ethylene glycol dimethacrylate, tetraethylene glycol dimethacrylate, polyethylene glycol dimethacrylate, 1,3-butylene glycol dimethacrylate, 1,6-hexanediol dimethaacryalte, neopentyl glycol dimethacrylate, polypropylene glycol dimethacrylate, 2,2'-bis{4-(methacryloxydiethoxy)phenyl}propane, trimethylolpropane trimethacrylate, tetramethylolmethane tetramethacrylate, divinyl ether, etc.

Monofunctional polymerizable monomers can be used alone or in combination. In addition, polyfunctional polymerizable monomers can be used together with one or more of monofunctional monomers. Among the monomers mentioned above, styrene and/or styrene derivatives are preferably used alone or in combination with other monomers in view of developability and durability of the resultant toner.

The following crosslinkers may present in polymerizing the polymerizing monomer to form a crosslinked polymer in a toner.

Specific examples of the crosslinkers include known crosslinking agents such as divinyl benzene, divinyl naphthalene, divinyl ether, divinyl sulfone, diethylene glycol dimethacrylate, triethylene glycol dimethacrylate, ethylene glycol dimethacrylate, polyethylene glycol dimethacrylate, diethylene glycol diacrylate, triethylene glycol diacrylate, 1,3-butylene glycol dimethacrylate, 1,6-hexanediol dimethaacryalte, neopentyl glycol dimethacrylate, dipropylene glycol dimethacrylate, polypropylene glycol dimethacrylate, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacylate, and allyl phthalate.

When a toner includes the crosslinker too much, the toner has low fixability. When too small, blocking resistance and durability of the toner deteriorates, and it is difficult to prevent offset phenomena wherein a part of the toner is not completely fixed on a paper, adheres to the surface of a roller of a heat roller fixer and transfers to the following paper. Therefore, a toner preferably includes the crosslinker in an amount of 0.001 to 15% by weight, and more preferably from 0.1 to 10% by weight based on total weight of the monomer.

The colorant is not particularly limited, and can be selected from known dyes and pigments in accordance with the purpose. Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A toner preferably includes the colorant in an amount of from 1 to 15% by weight, and more preferably from 3 to 10% by weight of the toner. When less than 1% by weight, the resultant toner cannot produce images with high image density. When greater than 15 5 by weight, problems in that the resultant toner cannot produce images with high image density and has poor electrostatic properties due to defective dispersion of the colorant in the toner occur.

Masterbatches, which are complexes of a colorant with a resin, can be used as the colorant of the toner of the present invention.

Specific examples of the resins for use as the binder resin of the master batches include polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Specific examples of the polymers of styrene or styrene derivatives include polystyrene, poly-p-chlorostyrene and polyvinyltoluene. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl $\alpha$-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The release agent is not particularly limited, and can be selected from known release agents in accordance with the purpose. Suitable materials for use as the release agent include waxes. Specific examples of the waxes include synthetic waxes such as low-molecular-weight polyolefin waxes, synthetic hydrocarbon waxes, natural waxes, petroleum waxes, higher fatty acids and their derivatives, higher fatty acid amide, and modified versions of these waxes. These waxes can be used alone or in combination.

Specific examples of the low-molecular-weight polyolefin waxes include low molecular weight polyethylene and polypropylene. Specific examples of the synthetic hydrocarbon waxes include Fischer-Tropsch waxes. Specific examples of the natural waxes include bees waxes, carnauba waxes, candelilla waxes, rice waxes, and montan waxes. Specific examples of the petroleum waxes include paraffin waxes and microcrystalline waxes. Specific examples of the higher fatty acids include stearic acid, palmitic acid and myristic acid.

The melting point of the release agent is not particularly limited, and can be selected in accordance with the purpose. However, the melting point is preferably from 40 to 160° C., more preferably from 50 to 120° C., and even more preferably from 60 to 90° C.

When the melting point is lower than 40° C., the resultant toner has a poor thermostability. When higher than 160° C., the toner causes a cold offset problem in that a part of the toner adheres to a fixing roller at a low temperature, and/or occurrence of a paper is wound around the fixing roller.

The content of the resale agent in a toner is no particularly limited, and can be selected in accordance with the purpose. However, the content is preferably from 0 to 40% by weight, and more preferably from 3 to 30% by weight, per 100% by weight of the toner. When greater than 40% by weight, problems in that the resultant toner has poor low temperature fixability and/or the resultant images have too high glossiness occur.

The inorganic particulate material is not particularly limited, and can be selected from known inorganic particulate materials in accordance with the purpose. Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. These are used alone or in combination.

The inorganic particulate material preferably has a primary particle diameter of from 5 nm to 2 μm, and more preferably from 5 nm to 500 nm. Further, the inorganic particulate material preferably has a specific surface area of from 20 to 500 $m^2/g$ when measured by a BET method.

A toner preferably includes the inorganic particulate material of from 0.01% to 5.0% by weight, and more preferably from 0.01% to 2.0% by weight.

The inorganic particulate material is preferably used as an external additive for a toner. The details will be explained later.

The charge controlling agent is not particularly limited, and can be selected from known charge controlling agents in accordance with the purpose. However, colorless or white charge controlling agents are preferably used because colored charge controlling agents change the color tone of a toner.

Specific examples thereof include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. Among these materials, metal salts of salicylic acid and salicylic acid derivatives are preferably used. These materials can be used alone or in combination.

Specific examples of the metal for use in the metal salts mentioned above include aluminum, zinc, titanium, strontium, boron, silicon, nickel, iron, chromium, zirconium, etc.

Specific examples of the marketed charge controlling agents include BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

The charge controlling agent can be included in the toner by a method in which a mixture of the charge controlling agent and the masterbatch, which have been melted and kneaded, is dissolved or dispersed in a solvent and the resultant solution or dispersion is dispersed in an aqueous medium to prepare a toner dispersion or a method in which the charge controlling agent is dissolved or dispersed together with other toner constituents to prepare a toner constituent mixture liquid and the mixture liquid is dispersed in an aqueous medium to prepare a toner dispersion. Alternatively, the charge controlling agent can be fixed on a surface of the toner after toner particles are prepared.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 1 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

The polymerized particulate material is not particularly limited, and can be selected from known polymerized particulate materials in accordance with the purpose. Specific examples thereof include polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins. These can be used alone or in combination.

The fluidity improver is a surface treatment agent to increase the hydrophobicity of a toner to prevent deterioration of fluidity and chargeability thereof even in an environment of high humidity. Specific examples thereof include a silane coupling agent, a sililating agent, a silane coupling agent having an alkyl fluoride group, an organic titanate coupling agent, an aluminum coupling agent a silicone oil and a modified silicone oil. These can be used alone or in combination.

The cleanability improver is added to remove a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. These can be used alone or in combination. The polymer particles comparatively have a narrow particle diameter distribution and preferably have a volume-average particle diameter of from 0.01 to 1 μm.

Specific examples of the magnetic materials include iron oxides such as magnetite, hematite and ferrite; metals such as cobalt and nickel; or their metal alloys and mixtures with aluminum, copper, lead, magnesium, tin, zinc, stibium, beryllium, bismuth, cadmium, calcium, manganese, selenium, titanium, tungsten, vanadium, etc.

The magnetic material preferably has an average particle diameter not greater than 2 μm, and more preferably of from 0.1 to 0.5 μm. A toner preferably includes the magnetic material in an amount of from 20 to 200 parts by weight, and more preferably from 40 to 150 parts by weight per 100 parts by weight of the polymerizing monomer.

The magnetic material preferably has a coercivity of from 1.6 to 24 kA/m, a saturated magnetization of from 50 to 200 $Am^2/kg$ and a remanent magnetization of from 2 to 20 $Am^2/kg$ when 800 kA/m is applied thereto.

In order to improve the dispersibility of the magnetic material in a toner, the surface of the magnetic material is preferably hydrophobized. Suitable hydrophobizing agents include coupling agents such as silane coupling agents and titanium coupling agents. Among these coupling agents, silane coupling agents are preferably used. Specific examples of the silane coupling agents include vinyl trimethoxy silane, vinyl triethoxy silane, γ-methacryloxypropyl trimethoxy silane, vinyl triacetoxy silane, methyl trimethoxy silane, methyl triethoxy silane, isobutyl trimethoxy silane, hydroxypropyl trimethoxy silane, phenyl trimethoxy silane, n-hexadecyl trimethoxy silane, n-octadecyl trimethoxy silane, etc.

Next, the emulsification coagulation method, suspension polymerization method and dispersion polymerization method will be explained.

First, the emulsification coagulation method will be explained.

The emulsification coagulation method emulsion-polymerizes or mini emulsion-polymerizes the polymerizing monomer in a liquid including an emulsified liquid of required additives to prepare polymerized particles; and associating the polymerized particles with an organic solvent, a flocculant, etc. to prepare a toner. Other emulsification coagulation methods include a method of coagulating or fusion bonding the polymerizing monomer in a dispersion including a release agent, a colorant, etc. required as toner constituents; and a method of dispersing the release agent, a colorant, etc. in the polymerizing monomer to prepare a dispersion, and emulsion-polymerizing the dispersion. The coagulating and fusion bond represent that plural particulate resins and particulate colorants are associated with one another. The aqueous medium for use in the present invention represents an aqueous medium including water in an amount not less than 50% by weight.

The methods are not particularly limited, and are disclosed in Japanese Laid-Open Patent Publications Nos. 5-565252, 6-329947 and 9-15904. Namely, the methods include associating plural dispersed particulate resins and colorants or particulate materials including a resin and a colorant. Particularly, after the dispersed particulate resins and colorants or the particulate materials are dispersed in water with an emulsifier to prepare a dispersion, a flocculant is added thereto such that the dispersion has a concentration of the flocculant not less than critical coagulation to salt out, and at the same time, the polymerized material is fusion bonded at a temperature not lower than a glass transition temperature thereof to form a fusion bonded particulate material. The particle diameter thereof is gradually grown and a large amount of water is added to stop growing the particle diameter. Further, the surface thereof is smoothed while heated and stirred, and the flowing particulate material including water is heated and dried to form a toner. In addition, an organic solvent unlimitedly soluble with water may be added with the flocculant.

The particulate polymerized material can be prepared by an emulsion polymerization method, a suspension polymerization method, a dispersion polymerization method, a precipitation polymerization method, an interfacial polymerization method, or pulverizing a synthesized resin, etc., and is preferably prepared by the emulsion polymerization method.

The particulate polymerized material can be prepared by polymerizing the polymerizing monomer with the polymerization initiator at a predetermined temperature.

Before the polymerizing monomer is polymerized with the polymerization initiator, the toner constituents such as the colorant, release agent, inorganic particulate material, charge controlling agent, polymerized particulate material, fluidity improver, cleanability improver and magnetic material are dispersed in the presence of a surfactant having a concentration not less than critical micelle concentration (CMC), and then the resultant dispersion is diluted such that the surfactant has a concentration not greater than CMC to combine the resin and constituents.

The particulate polymerized material preferably has a particle diameter of from 0.01 to 10 μm.

The flocculant is not particularly limited, but a flocculant selected from metallic salts is preferably used. Univalent metals include alkali metals such as sodium, kalium and lithium. Bivalent metals include alkaline earth metals such as calcium and magnesium, and manganese, copper, etc. Trivalent metals include iron, aluminum, etc. Specific examples of the metallic salts include sodium chloride, kalium chloride, lithium chloride, calcium chloride, zinc chloride, copper sulfate, magnesium sulfate, manganese sulfate, etc. These can be used in combination.

The flocculant is preferably added to a toner so as to have a concentration not less than a critical coagulation concentration thereof. The critical coagulation concentration is a standard in relation to stability of an aqueous dispersed material, and is a concentration of the flocculant, at which the coagulation starts. The critical coagulation concentration largely changes in accordance with an emulsified component and a dispersant. "High Polymer Chemistry 17,601" written by Mr. Seizou Okamura and published in 1960 by Japan High Polymer Academy discloses a method of determining the critical coagulation concentration. Another method includes adding a desired salt into a dispersion including particles; measuring a zeta potential thereof; and determining the salt concentration changing the zeta potential as the critical coagulation concentration.

The flocculant is preferably added to a toner 1.2 times, and more preferably 1.5 times as much as the critical coagulation concentration The organic solvent unlimitedly soluble with water does not dissolve the resin formed in the present invention. Specific examples thereof include alcohols such as methanol, ethanol, propanol, isopropanol, t-butanol, methoxyethanol and butoxyethanol; nitrites such as acetonitrile; and ethers such as dioxane. Particularly, the ethanol, propanol and isopropanol are preferably used.

The organic solvent unlimitedly soluble with water is preferably added in an amount of from 1 to 100% by volume based on total weight of a dispersion including a polymer.

In order to uniform the shape of a toner, after colored particles are prepared and filtered, a slurry including water in an amount not less than 10% by weight is preferably flown through the particles and dried, and when a polymer in the toner preferably includes a polar group. This is because the water swells the polymer in some degree to uniform the shape of a toner.

Next, the suspension polymerization method will be explained.

The suspension polymerization method prepares a toner by putting and stirring a polymerizing mixture including a polymerizing monomer, a polymerization initiator, a colorant, a release agent, etc. in an aqueous medium including a suspension stabilizer to form polymerized particles. The suspension polymerization method preferably prepares a toner by putting and stirring a polymerizing mixture including a polymerizing monomer, a polymerization initiator, a colorant, a release agent and a cationic polymer in an aqueous dispersion medium including an anionic dispersant. The thus prepared toner includes the release agent in the suspended particle and has noticeably improved fixability and offset resistance.

The method is not particularly limited, and is disclosed in, e.g., Japanese Patent Publication No. 36-10231, 47-51830, 51-14895, 53-17735, 53-17736 and 53-17737.

A dispersion stabilizer can be used to well disperse the polymerizing monomer constituents in the aqueous dispersion medium. The dispersion stabilizer can be used alone or in combination.

Specific examples of inorganic dispersants include particles (having a particle diameter not greater than 1 μm) of metals such as cobalt, iron, nickel, aluminum, copper, tin, lead and magnesium, and metal alloys thereof; particulate inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, titania, iron oxide, copper oxide, nickel oxide, zinc oxide, pigments and dyes such as carbon black, Nigrosine dyes, Aniline Blue, Chrome Yellow, Phthalocyanine Blue and Rose Bengale.

Specific examples of the organic dispersants include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerin monoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the dispersant. Further, copolymers of the above-mentioned hydrophilic monomers with monomers having a benzene ring or the derivatives of the monomers; copolymers of the above-mentioned hydrophilic monomers with derivatives of acrylic acid or methacrylic acid, such as acrylonitrile, methacrylonitrile and acrylamide; and copolymers of the above-mentioned hydrophilic monomers with one or more of crosslinking monomers such as ethylene glycol dimethacrylate, diethylene glycol methacrylate, ally methacrylate, and divinyl benzene, can also be used as the dispersant.

In addition, particulate resins can also be used as the dispersant. Suitable resins for use as the dispersant include any known thermoplastic or thermosetting resins which can form a dispersion in an aqueous medium. Specific examples of such resins include vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, at least one of the vinyl resins, the polyurethane resins, the epoxy resins and the polyester resins is preferably used because an aqueous dispersion including a microscopic spherical particulate resin can easily be prepared with the resin.

Specific examples of the vinyl resins include homopolymerized or copolymerized polymers such as styrene-(metha)esteracrylate resins, styrene-butadiene copolymers, (metha)acrylic acid-esteracrylate polymers, styrene-acrylonitrile copolymers, styrene-maleic acid anhydride copolymers and styrene-(metha)acrlic acid copolymers.

As the particulate resin, a copolymer including a monomer having at least two unsaturated groups can also be used. The monomer having at least two unsaturated groups is not particularly limited, and can be selected in accordance with the purpose. Specific examples thereof include a sodium salt of a sulfate ester with an additive of ethylene oxide methacrylate (ELEMINOL RS-30 from Sanyo Chemical Industries, Ltd.), divinylbenzene, 1,6-hexanediolacrylate, etc.

The particulate resin preferably has a volume-average particle diameter of from 20 to 400 nm, and more preferably from 30 to 350 nm. When less than 20 nm, the particulate resin remaining on the surface of a toner becomes a film and thickly covers all the surface thereof, resulting in deterioration of adherence thereof to a transfer material and increase of a fixable minimum temperature thereof. When greater than 400 nm, the particulate resin prevents a wax from exuding, resulting in insufficient releasability thereof and offset problems.

The particulate resin preferably covers a toner with a coverage of from 75 to 100%, and more preferably from 80 to 100%. When less than 75%, the storage stability of a toner deteriorates and blocking thereof occasionally occurs. A toner preferably includes the particulate resin in an amount of from 0.5 to 8.0%, and more preferably from 0.6 to 7.0% by weight. When less than 0.5% by weight, the storage stability thereof deteriorates and blocking thereof occasionally occurs. When greater than 8.0% by weight, the particulate resin prevents a wax from exuding, resulting in insufficient releasability thereof and offset problems.

The dispersion stabilizer is preferably used in an amount of from 0.2 to 10.0 by weight per 100 parts by weight of the polymerizing monomer.

The marketed dispersion stabilizer may be used as it is, and when the inorganic compound is used as the dispersion stabilizer, the inorganic compound can be produced in a stirred dispersion medium to prepare dispersed particles having a minute uniform particle diameter. For example, an aqueous solution of sodium phosphate and an aqueous calcium chloride are mixed in stirred water to produce the tricalcium phosphate.

In order to minutely disperse the inorganic dispersant, a surfactant in an amount of from 0.001 to 0.1% by weight based on total weight of the polymerizing monomer may be used. The surfactant accelerates the initial operation of the dispersion stabilizer. The surfactant is not particularly limited, however, the following ionic surfactants are preferably used.

Specific examples of the ionic surfactants include sulfonates (e.g., sodium dodecylbenzenesulfonate, sodium arylalkylpolyether sulfonate, sodium 3,3-disulfonediphenylurea-4,4-diazo-bis-amino8-naphthol-6-sulfonate, o-carboxylbenzene-azo-dimethylaniline, and sodium 2,2,5,5-tetramethyl-triphenylmethane-4,4-diazo-bis-β-naphthol-6-sulfonate); sulfates (e.g., sodium dodecylsulfate, sodium tetradecylsulfate, sodium pentadecylsulfate and sodium octylsulfate); salts of fatty acid (e.g., sodium oleate, sodium laurate, sodium caprate, sodium caprylate, sodium caproate, potassium stearate and calcium oleate; etc.

In addition, nonionic surfactants can be used. Specific examples of the nonionic surfactants include polyethylene oxide, polypropylene oxide, combinations of polyethylene oxide and polypropylene oxide, esters of polyethylene glycol and higher fatty acids, alkylphenolpolyethylene glycol, esters of polypropylene oxide and higher fatty acids, sorbitan esters, etc.

Since a monomer readily soluble in water is emulsified and polymerized at the same time in water, and contaminates the produced suspended polymer with small emulsified and polymerized particles, a water-soluble polymerization inhibitor such as a metallic salt may be added to prevent the emulsification and polymerization in water. In addition, a polyalcohol such as glycerin and glycol may be added in water to increase viscosity of a continuous phase (dispersion medium) and prevent the particles from being combined one another. In addition, salts such as NaCl, KCl and $Na_2SO_4$ may be used to decrease solubility of a readily-soluble monomer in water. In the present invention, these are used as an emulsifier when emulsifying and polymerizing, however, these may be used for other processes and purposes of use.

Next, the dispersion polymerization method will be explained.

The dispersion polymerization method includes preparing a mixed liquid including a hydrophilic organic solvent and a polymer dispersant; and adding a polymerizing monomer soluble in the hydrophilic organic solvent, the resultant polymer of which is scarcely soluble therein and swelling, to form polymerized particles.

The method is not particularly limited, and is disclosed in Japanese Laid-Open Patent Publications Nos. 4-306664, 5-181315, 7-092731 and 8-160660.

Specific examples of the hydrophilic organic solvents include alcohols such as methyl alcohol, ethyl alcohol, denatured alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, tetrahydrofurfuryl alcohol, ethylene glycol, glycerin, and diethylene glycol; ether alcohols such as methylcellosolve, cellosolve, isopropyl cellosolve, butyl cellosolve, ethylene glycol monomethyl ether, ethylene glycol monoethyl ether, diethylene glycol monomethyl ether, and diethylene glycol monoethyl ether; etc. These solvents are used alone or in combination.

By using an organic solvent in combination with the above-mentioned alcohols and ether alcohols, it becomes possible to perform polymerization under conditions in which generated particles are insoluble in the mixture solvent by properly controlling the SP value of the mixture solvent and polymerization conditions. By using this method, problems in that the generated particles are adhered to each other, resulting in agglomeration of the particles, and new particles are generated can be avoided. Specific examples of such organic solvents include hydrocarbons such as hexane, octane, petroleum ether, cyclohexane, benzene, toluene and xylene; halogenated hydrocarbons such as carbon tetrachloride, trichloroethylene, and tetrabromoethane; ethers such as ethyl ether, dimethyl glycol, trioxane, and tetrahydrofuran; acetals such as methylal and diethyl acetal; ketones such as acetone, methyl ethyl ketone, methyl isobutyl ketone and cyclohexanone; esters such as butyl formate, butyl acetate, ethyl propionate, and cellosolve acetate; acids such as formic acid, acetic acid and propionic acid; compounds having a sulfur atom or a nitrogen atom such as nitropropene, nitrobenzene, dimethylamine, monoethanolamine, pyridine, dimethylsulfoxide and dimethyl formamide; water; etc.

The hydrophilic organic solvents may include $SO_4^{2-}$, $NO_2^-$, $PO_4^{3-}$, $CL^-$, $Na^+$, $K^+$, $Mg^{2+}$, $Ca^{2+}$ and other inorganic ions.

In addition, in order to disperse the polymerizing monomer constituents in an aqueous dispersion medium, the above-mentioned dispersion stabilizer and surfactants may optionally be added thereto.

In accordance with target average particle diameter and particle diameter distribution, a mixing ratio and a concentration of the dispersion stabilizer, the surfactant and the polymerizing monomer in the hydrophilic organic solvent are determined. The concentrations of the dispersion stabilizer and surfactant are typically high such that the polymerized particles have a small average particle diameter, and the concentrations of the dispersion stabilizer and surfactant are low such that the polymerized particles have a large average particle diameter. On the other hand, the concentration of the polymerizing monomer is low such that the polymerized particles have quite a sharp particle diameter distribution, and the concentration of the polymerizing monomer is high such that the polymerized particles have comparatively a wide particle diameter distribution.

When the dispersion stabilizer is used in an amount greater than 50 times as much as the preferred amount, it is typically difficult to form particles having a particle diameter larger or smaller than the average particle diameter by 25% in an amount of 90% by weight. The content of the dispersion stabilizer is dependent on the polymerizing monomer, however, preferably from 1 to 10%, and more preferably from 1 to 5% by weight. When the dispersion stabilizer has a low concentration, the resultant polymer particles have comparatively a large particle diameter. When the dispersion stabilizer has a high concentration, the resultant polymer particles have a small particle diameter. However, when the content of the dispersion stabilizer is greater than 10% by weight, the resultant polymer particles does not effectively have a small particle diameter.

Next, granulating in a liquid solvent will be explained.

When the monomer constituents are granulated in an aqueous medium, a disperser such as a stirrer having high shear strength such as a conventional stirrer, the T.K. HOMOMIXER from TOKUSHU KIKA KOGYO CO., LTD., the CLEARMIX from MTECHNIQUE Co., LTD.; and an ultrasonic disperser disperses the monomer constituents to prepare a polymerizing constituents dispersion. The stirrer preferably has a turbine-type stirring blade rather than a paddle-type stirring blade. Alternatively, a dispersion phase is pressed into a continuous phase of a porous material such as a porous glass to prepare a polymerizing constituents dispersion. When dispersing upon application of shear stress, the stirring speed and time are preferably controlled such that the resultant monomer constituents have a particle diameter not greater than 30 μm. Specifically, the turbine preferably has a peripheral speed of from 10 to 30 m/sec, and the granulating time is not particularly limited, however, is preferably from 5 to 60 min. 100 parts by weight of the monomer constituents are preferably dispersed by from 200 to 3,000 parts by weight. When polymerized, oxygen in a reaction container needs to be fully purged with an inactive gas such as a nitrogen gas and an argon gas. When insufficiently purged, microparticles tend to generate.

The granulated polymerizing constituents are further polymerized to prepare toner particles for use in the present invention. When further polymerized, it is preferable that the dispersion stabilizer maintains the dispersion status and the particle settling is prevented. The polymerization temperature is preferably not less than 40° C., and more preferably from 60 to 90° C. The polymerization time is preferably from 2 to 48 hrs. The polymerization can be terminated when the particles have a desired particle diameter and a distribution thereof, or a polymerization initiator can be added to speed up the polymerization.

The polymerized particles are optionally subjected to an acid, an alkali or others to remove the dispersant. Alternatively, the particles are washed to remove the dispersant.

When associating polymerized microparticles with each other in the emulsification coagulation method, a disperser such as a stirrer having high shear strength such as a conventional stirrer, the T.K. HOMOMIXER from TOKUSHU KIKA KOGYO CO., LTD., the CLEARMIX from MTECHNIQUE Co., LTD. disperses the polymerized microparticles, and a colorant, a release agent and a flocculant are added to form associated particles. The reaction temperature, pH and stirring speed need to be controlled to control the particle diameter thereof. The granulating time is not particularly limited, however, is preferably from 5 to 60 min.

The toner for use in the present invention preferably has the following volume-average particle diameter, ratio thereof to a number-average particle diameter (volume-average particle diameter/number-average particle diameter), molecular weight, glass transition temperature, penetration, low-temperature fixability, heat properties, image density, average circularity, etc.

The toner at least has a volume-average particle diameter (Dv) of from 0.1 to 10 μm, and preferably from 2 to 8 μm, and a ratio (Dv/Dn) thereof to a number-average particle diameter (Dn) not greater than 1.25, and more preferably from 1.05 to 1.25. Such a toner has a good thermostable preservability, a good low-temperature fixability and a good hot offset resistance, and above all has a good glossiness when used in a full-color copier. Further, when used in a two-component developer, a particle diameter thereof less fluctuates even after the toner is consumed and fed for long periods, and the toner has a stable developability even after stirred in an image developer for long periods. When used as a one-component developer, a particle diameter thereof less fluctuates without filming over a developing roller and fusion bond to a blade forming a thin layer of the toner even after the toner is consumed and fed for long periods. Further, the toner has a good and stable developability even after stirred in an image developer for long periods.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer melts and adheres to a surface of a carrier to deteriorate chargeability thereof when stirred for a long time in an image developer. When the toner is used in a one-component developer, toner filming over a developing roller and fusion bond of the toner to a blade forming a thin layer thereof tend to occur. These phenomena also occur when a content of fine particles in the toner is larger than the scope of the present invention.

When the average particle diameter is larger than the scope of the present invention, the resultant toner has a difficulty in producing high resolution and quality images. In addition, the resultant toner has a large variation of the particle diameters in many cases after the toner in a developer is consumed and fed for long periods. When Dv/Dn is greater than 1.25, these phenomena also occur. When less than 1.05, the toner has a stable behavior and is uniformly charged, but occasionally the toner is not sufficiently charged and has poor cleanability.

The volume-average particle diameter (Dv) and the ratio (Dv/Dn) thereof to the number-average particle diameter (Dn) of the toner can be measured by a Coulter Counter TA-II from Coulter Electronics, Ltd.

The weight-average molecular weight of the toner is not particularly limited, and can be selected in accordance with the purpose, which is preferably not less than 1,000, more preferably from 2,000 to 10,000,000, and much more preferably from 3,000 to 1,000,000.

When less than 1,000, the resultant toner occasionally has poor hot offset resistance.

The glass transition temperature (Tg) of the toner is not particularly limited, and can be selected in accordance with the purpose, which is preferably from 30 to 70° C., and more preferably from 40 to 65° C. When less than 30° C., the resultant toner occasionally has poor thermostable storage stability. When higher than 70° C., the resultant toner occasionally has insufficient low-temperature fixability.

The penetration is preferably not less than 15 mm, and more preferably from 20 to 30 mm when measured by the method specified in JIS K2235-1991. Specifically, a glass container having a capacity of 50 ml is filled with a toner, and the glass container is left in a constant-temperature bath at 50° C. Then, the toner is cooled to have a room temperature and a penetration test is performed.

When less than 15 mm, the resultant toner occasionally has poor thermostable storage stability.

The larger the penetration, the better the thermostable storage stability.

The minimum fixable temperature is preferably not greater than 150° C. and a temperature at which the offset does not occur is preferably not less than 200° C. to lower the minimum fixable temperature and prevent the offset. The minimum fixable temperature is a temperature of a fixing roller in an image forming apparatus producing images having an image density not less than 70% after scraped with a pad.

The heat properties are, in other words, flow tester properties, and include a softening point (Ts), a flow starting temperature (Tfb), a 1/2 softening point (T1/2), etc. The heat properties can be measured by a method optionally selected, such as a flow curve using an elevated flow tester CFT500 from Shimadzu Corporation.

The softening point (Ts) is not particularly limited, and can be selected in accordance with the purpose, which is preferably not less than 50° C., and more preferably from 80 to 120° C. When less than 50° C., the resultant toner occasionally has poor thermostable storage stability or low temperature storage stability. The flow starting temperature (Tfb) is not particularly limited, and can be selected in accordance with the purpose, which is preferably not less than 60° C., and more preferably from 70 to 150° C. When less than 60° C., the resultant toner occasionally has poor thermostable storage stability or low temperature storage stability.

The 1/2 softening point (T1/2) is not particularly limited, and can be selected in accordance with the purpose, which is preferably not less than 60° C., and more preferably from 80 to 170° C. When less than 60° C., the resultant toner occasionally has poor thermostable storage stability or low temperature storage stability.

The image density measured by a spectrometer SPECTRODENSITOMETER 938 from X-Rite is preferably not less than 1.90, more preferably not less than 2.00, and much more preferably not less than 2.10. A high quality image has an image density not less than 1.90.

For example, imagio Neo 450 from Ricoh Company, Ltd. forms a solid image with a developer in an adhered amount of 1.00±0.05 mg/cm$^2$ on a copy paper TYPE6000<70W> from Ricoh Company, Ltd. at a surface temperature of 160±2° C. of the fixing roller, and an average of image density of random 6 parts of the solid image, measured by the spectrometer, is determined as the image density.

A peripheral length of a circle having a projected area equivalent to the shape of the toner is divided by a peripheral length of the actual toner particle to determine the average circularity of the toner. The average circularity is preferably from 0.900 to 1.000, and more preferably from 0.950 to 0.990. Further, the toner preferably has particles having a circularity less than 0.94 in an amount not greater than 15%. When the average circularity is less than 0.900, the resultant toner does not have satisfactory transferability and does not produce high-quality images without scattered toner. As a method of identifying the shape, an optical detection method of passing a suspension including a particle through a tabular imaging detector and optically detecting and analyzing the particle image with a CCD camera is used, e.g., the average circularity can be measured by a flow-type particle image analyzer FPIA-2000 from SYSMEX CORPORATION.

As mentioned above, in the method of preparing the toner of the present invention, the supercritical fluid or the subcritical fluid removes the unsaturated carboxylic acid monomer on the surface of the toner. Consequently, the chargeability and fluidity of the toner, which the unsaturated carboxylic acid monomer deteriorates, can be improved.

After the unsaturated carboxylic acid monomer is removed from a toner, an inorganic particulate material is preferably used as an external additive to improve fluidity, developability and chargeability of the toner. The inorganic particulate material preferably has a primary particle diameter of from 5 mμ to 2 μm, and more preferably from 5 to 500 mμ. The toner preferably has a BET specific surface area of from 20 to 500 $m^2/g$. The toner preferably includes the inorganic particulate material in an amount of from 0.01 to 5% by weight, and more preferably from 0.01 to 2.0% by weight.

Specific preferred examples of the inorganic particulate material include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Besides, specific preferred examples of suitable polymer particulate materials include polystyrene formed by a soap-free emulsifying polymerization, a suspension polymerization or a dispersing polymerization, methacrylate ester or acrylate ester copolymers, silicone resins, benzoguanamine resins, polycondensation particles such as nylon and polymer particles of thermosetting resins A surface treatment agent can increase the hydrophobicity of these fluidizers and prevent deterioration of fluidity and chargeability of the resultant toner even in high humidity. Any desired surface treatment agent may be used, depending on the properties of the treated particle of interest. Specific preferred examples of the surface treatment agent include silane coupling agents, silylating agents, silane coupling agents having an alkyl fluoride group, organic titanate coupling agents, aluminum coupling agents silicone oils and modified silicone oils.

The inorganic particulate material used as an external additive is preferably same as that included in the organic solvent.

The toner may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

A mixer mixing the toner and the external additive is not particularly limited, provided that a shaft thereof can be sealed with a gas, a stirring blade thereof can rotate at a high speed and a container thereof can wholly be cooled or heated. Specific examples of the mixer include HENSCHEL MIXER from Mitsui Mining Co., Ltd. and SUPER MIXER from KAWATA MFG Co., Ltd. Specific examples of the sealing gas include, but are not limited to, noble gases such as helium and argon, nitrogen and a dry air.

The mixer preferably contains the colorant in an amount of from 0.05 to 0.4 kg/l, and more preferably from 0.1 to 0.3 kg/l. When less than 0.05 kg/l, the productivity lowers. When greater than 0.4 kg/l, the colorant and/or the toner are discharged from the mixer and the yield occasionally lowers. The external additive is preferably added, but is not limited to, in an amount of from 0.1 to 6 parts by weight, more preferably from 0.3 to 5 parts by weight and much more preferably from 0.5 to 3 parts by weight.

After the external additive is mixed with the toner, the toner can be sieved to remove coarse particles, fusion bonded coarse particles due to a mechanical heat and re-coagulated particles due to a van der Waals force. For example, the toner is passed through a sieve having opening of from 100 to 250 μm. Apparatuses having the sieve include a multistage gyro shifter, and shifting methods include mechanical shifting methods and ultrasonic shifting methods.

The developer of the present invention includes at least the toner of the present invention, and optionally other components such as a carrier. The developer may be a one-component developer or a two-component developer, however, the two-component developer having a long life is preferably used in high-speed printers in compliance with the recent high information processing speed.

Even the one-component developer or two-component developer of the present invention has less variation of particle diameter of the toner even after repeatedly used, good and stable developability and produces quality images for long periods without filming over a developing roller and fusion bonding to a member such as a blade forming a thin layer of the toner.

The carrier is not particularly limited, and can be selected in accordance with the purpose, however, preferably includes a core material and a resin layer coating the core material.

The core material is not particularly limited, and can be selected from known materials such as Mn—Sr materials and Mn—Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images. These can be used alone or in combination.

The core material preferably has a volume-average particle diameter of from 10 to 150 μm, and more preferably from 40 to 100 μm. When less than 10 μm, a magnetization per particle is so low that the carrier scatters. When larger than 150 μm, a specific surface area lowers and the toner occasionally scatters, and a solid image of a full-color image occasionally has poor reproducibility.

The resin coating the core material is not particularly limited, and can be selected in accordance with the purpose. Specific examples of the resin include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. These can be used alone or in combination.

Specific examples of the amino resins include urea-formaldehyde resins, melamine resins, benzoguanamine resins, urea resins, polyamide resins, epoxy resins, etc. Specific examples of the polyvinyl resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins, styrene-acrylic copolymers, etc. Specific examples of the halogenated olefin resins include polyvinyl chloride resins, etc. Specific examples of the polyester resins include polyethyleneterephthalate resins, polybutyleneterephthalate resins, etc.

An electroconductive powder may optionally be included in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include, but are not limited to, toluene, xylene, methyl ethyl ketone, methyl isobutyl ketone, cellosolve butyl acetate, etc.

Specific examples of the burning methods include, but are not limited to, externally heating methods or internally heating methods using fixed electric ovens, fluidized electric ovens, rotary electric ovens, burner ovens, microwaves, etc.

The carrier preferably includes the resin layer in an amount of from 0.01 to 5.0% by weight. When less than 0.01% by weight, a uniform resin layer cannot be formed on the core material. When greater than 5.0% by weight, the resin layer becomes so thick that carrier particles granulate one another and uniform carrier particles cannot be formed.

The content of the carrier in the two-component developer is not particularly limited, can be selected in accordance with the purpose, and is preferably from 90 to 98% by weight, and more preferably from 90 to 97% by weight.

The developer of the present invention can prevent odor development, has good low temperature fixability and releasability, and can stably produce high-quality images. The developer of the present invention can preferably be used in known electrophotographic image forming methods such as magnetic one-component developing methods, non-magnetic one-component developing methods and two-component developing methods. Particularly, the developer of the present invention can preferably be used in the following toner container, process cartridge, image forming apparatus and image forming method of the present invention.

The toner container of the present invention contains the toner or the developer of the present invention.

The container is not particularly limited, and can be selected from known containers such as a container having a cap. The size, shape, structure, material, etc. thereof are not particularly limited, and can be selected in accordance with the purpose. The container preferably has the shape of a cylinder, and particularly, the cylinder preferably has a spiral concavity and convexity on the inside surface thereof such that a toner can transfer to an exit thereof when the cylinder rotates. In addition, apart or the all of the spiral is preferably a cornice.

The materials for the container are not particularly limited, and resins having good size precision are preferably used, such as polyester resins, polyethylene resins, polypropylene resins, polystyrene resins, polyvinylchloride resins, polyacrylate resins, polycarbonate resins, ABS resins and polyacetal resins.

The toner container of the present invention is easy to store, transport and handle, and is detachable from the process cartridge and the image forming apparatus of the present invention mentioned later, to feed the toner thereto.

The process cartridge of the present invention includes at least an electrostatic latent image bearer bearing an electrostatic latent image and an image developer developing the electrostatic latent image with a developer to form a visible image, and optional other means. The image developer includes at least a developer container containing the toner or developer of the present invention and a developer bearer bearing the toner or developer contained in the container, and further may include a layer thickness regulator regulating a layer thickness of the toner. The process cartridge of the present invention can be detachable from various electrophotographic image forming apparatuses, and is preferably detachable from the image forming apparatus of the present invention mentioned later.

FIG. 1 is a schematic view illustrating an embodiment of the process cartridge of the present invention.

In an image forming apparatus using the process cartridge 450 of the present invention, a photoreceptor 451 rotates at a predetermined peripheral speed. A peripheral surface of the photoreceptor 451 is positively or negatively charged uniformly by a charger 452 while the photoreceptor is rotating to have a predetermined potential. Next, the photoreceptor receives an imagewise light from an irradiator, such as a slit irradiator and a laser beam scanner to form an electrostatic latent image on the peripheral surface thereof. Then, the electrostatic latent image is developed by an image developer 453 with a toner to form a toner image. Next, the toner image is transferred onto a transfer material fed between the photoreceptor and a transferer from a paper feeder in synchronization with the rotation of the photoreceptor. Then, the transfer material which received the toner image is separated from the surface of the photoreceptor and led to an image fixer fixing the toner image on the transfer material to form a copy image which is discharged out of the apparatus. The surface of the photoreceptor is cleaned by a cleaner 454 to remove a residual toner after transfer, and is discharged to repeat forming images.

The image forming method of the present invention includes developing an electrostatic latent image formed on an image bearer with a developer to form a toner image thereon; transferring the toner image formed on the image bearer onto an image support medium; and fixing the transferred toner image to form a fixed image thereon. Hereinafter, an image forming apparatus preferably used in the image forming method of the present invention will be explained.

The image forming apparatus includes at least an electrostatic latent image bearer, an electrostatic latent image former, an image developer, a transferer and a fixer, and optional other means such as a discharger, a cleaner, a recycler and a controller.

The material, shape, structure, size, etc. of the electrostatic latent image bearer (so-called a photoconductive insulator or a photoreceptor) are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine. Among these materials, the amorphous silicon having long life is preferably used.

An amorphous silicon photoreceptor (hereinafter referred to as an a-Si photoreceptor) can be used in the present invention. An a-Si photoreceptor can, for example, be formed by heating an electroconductive substrate at from 50 to 400° C. and forming an a-Si photosensitive layer on the substrate by a vacuum deposition method, a sputtering method, an ion plating method, a heat CVD method, a photo CVD method, a plasma CVD method, etc. Particularly, the plasma CVD method is preferably used, which forms an a-Si layer on the substrate by decomposing a gas material with a DC, high-frequency or microwave glow discharge.

FIGS. 2A to 2D are schematic views illustrating a photosensitive layer composition of the amorphous photoreceptor for use in the present invention respectively. An electrophotographic photoreceptor 500 in FIG. 2A includes a substrate 501 and a photosensitive layer 503 thereon, which is photoconductive and formed of a-Si. An electrophotographic photoreceptor 500 in FIG. 2B includes a substrate 501, a photosensitive layer 502 thereon and an a-Si surface layer 503 on the photosensitive layer 502. An electrophotographic photoreceptor 500 in FIG. 2C includes a substrate 501, a charge injection prevention layer 504 thereon, a photosensitive layer 502 on the charge injection prevention layer 504 and an a-Si surface layer 503 on the photosensitive layer 502. An electrophotographic photoreceptor 500 in FIG. 2D includes a substrate 501, a photosensitive layer 502 thereon including a charge generation layer 505 and a charge transport layer formed of a-Si, and an a-Si surface layer 503 on the photosensitive layer 502.

The substrate of the photoreceptor may either be electroconductive or insulative. Specific examples of the substrate include metals such as Al, Cr, Mo, Au, In, Nb, Te, V, Ti, Pt, Pd and Fe and their alloyed metals such as stainless. In addition, insulative substrates such as films or sheets of synthetic resins such as polyester, polyethylene, polycarbonate, cellulose acetate, polypropylene, polyvinylchloride, polystyrene, polyamide; glasses; and ceramics can be used, provided that at least a surface of the substrate, on which a photosensitive layer is formed, is treated to be electroconductive.

The substrate preferably has the shape of a cylinder, a plate or an endless belt having a smooth or a concave-convex surface. The substrate can have any desired thickness, which can be as thin as possible when an electrophotographic photoreceptor including the substrate is required to have flexibility. However, the thickness is typically not less than 10 μm in terms of production and handling conveniences, and mechanical strength of the electrophotographic photoreceptor.

Figure 2A:
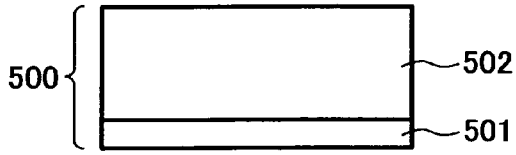
FIGS. 2A to 2D are schematic views illustrating embodiments of photosensitive layer compositions of the amorphous silicone photoreceptor for use in the present invention.
Figure 2B:
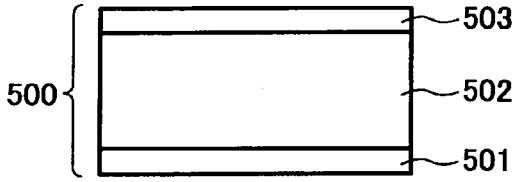
Figure 2C:
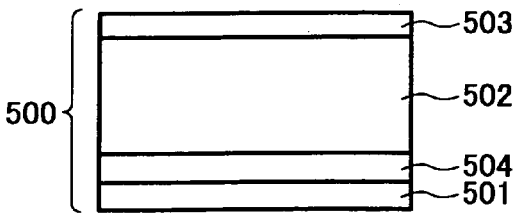
Figure 2D:
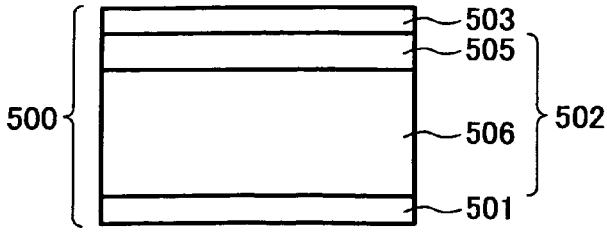

The a-Si photoreceptor of the present invention may optionally include a charge injection prevention layer 504 between the electroconductive substrate 511 and the photosensitive layer 502 in FIG. 2C. When the photosensitive layer 502 is charged with a charge having a certain polarity, the charge injection prevention layer 504 prevents a charge from being injected into the photosensitive layer 502 from the substrate 511. However, the charge injection prevention layer 504 does not prevent this when the photosensitive layer 502 is charged with a charge having a reverse polarity, i.e., having a dependency on the polarity. The charge injection prevention layer 504 includes more atoms controlling conductivity than the photosensitive layer 502 to have such a capability.

The charge injection prevention layer 504 preferably has a thickness of from 0.1 to 5 μm, more preferably from 0.3 to 4 μm, and most preferably from 0.5 to 3 μm in terms of desired electrophotographic properties and economic effects.

The photosensitive layer 502 is formed on an undercoat layer optionally formed on the substrate 511 and has a thickness as desired, and preferably of from 1 to 100 μm, more preferably from 20 to 50 μm, and most preferably from 23 to 45 μm in terms of desired electrophotographic properties and economic effects.

The charge transport layer 506 is a layer transporting a charge when the photosensitive layer 502 is functionally separated. The charge transport layer 506 includes at least a silicon atom, a carbon atom and a fluorine atom, and optionally includes a hydrogen atom and an oxygen atom. Further, the charge transport layer has photosensitivity, charge retainability, charge generation capability and charge transportability as desired. In the present invention, the charge transport layer preferably includes an oxygen atom.

The charge transport layer 506 has a thickness as desired in terms of electrophotographic properties and economic effects, preferably of from 5 to 50 μm, more preferably from 10 to 40 μm, and most preferably from 20 to 30 μm.

The charge generation layer 505 is a layer generating a charge when the photosensitive layer 502 is functionally separated. The charge generation layer 505 includes at least a silicon atom, does not substantially include a carbon atom and optionally includes a hydrogen atom. Further, the charge generation layer 505 has photosensitivity, charge generation capability and charge transportability as desired.

The charge generation layer has a thickness as desired in terms of electrophotographic properties and economic effects, preferably of from 0.5 to 15 μm, more preferably from 1 to 10 μm, and most preferably from 1 to 5 μm.

The a-Si photoreceptor for use in the present invention can optionally include a surface layer on the photosensitive layer 502 located on the substrate, which is preferably an a-Si surface layer 503. The surface layer has a free surface and is formed to attain objects of the present invention in humidity resistance, repeated use resistance, electric pressure resistance, environment resistance and durability of the photoreceptor.

The surface layer 503 preferably has a thickness of from 0.01 to 3 μm, more preferably from 0.05 to 2 μm, and most preferably from 0.1 to 1 μm. When less than 0.01 μm, the surface layer is lost due to abrasion during use of the photoreceptor. When greater than 3 μm, deterioration of the electrophotographic properties occurs, such as an increase of residual potential of the photoreceptors.

The a-Si silicon photoreceptor has a high surface hardness, a high sensitivity to light having a long wavelength of from 770 to 800 nm such as a laser diode, little deterioration due to repeated use, and therefore is advantageously used as an electrophotographic photoreceptor for high-speed copiers and laser beam printers (LBP).

The electrostatic latent image is formed by uniformly charging the surface of the electrostatic latent image bearer and irradiating imagewise light onto the surface thereof with the electrostatic latent image former. The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage. The charger is not particularly limited, and can be selected in accordance with the purpose, such as an electroconductive or semiconductive rollers, bushes, films, known contact chargers with a rubber blade, and non-contact chargers using a corona discharge such as corotron and scorotron.

The surface of the electrostatic latent image bearer is irradiated with the imagewise light by the irradiator. The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators. In the present invention, a backside irradiation method irradiating the surface of the electrostatic latent image bearer through the backside thereof may be used.

The visible image is formed by the image developer developing the electrostatic latent image with the toner or developer of the present invention. The image developer is not particularly limited, and can be selected from known image developers, provided that the image developer can develop with the toner or developer of the present invention. For example, an image developer containing the toner or developer of the present invention and being capable of imparting the toner or developer to the electrostatic latent image is preferably used.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

The developer contained in the image developer is a developer including the toner of the present invention, and may be a one-component developer or a two-component developer. A toner included therein is the toner of the present invention.

An alternate electric field is applied in the developing process.

Figure 3:
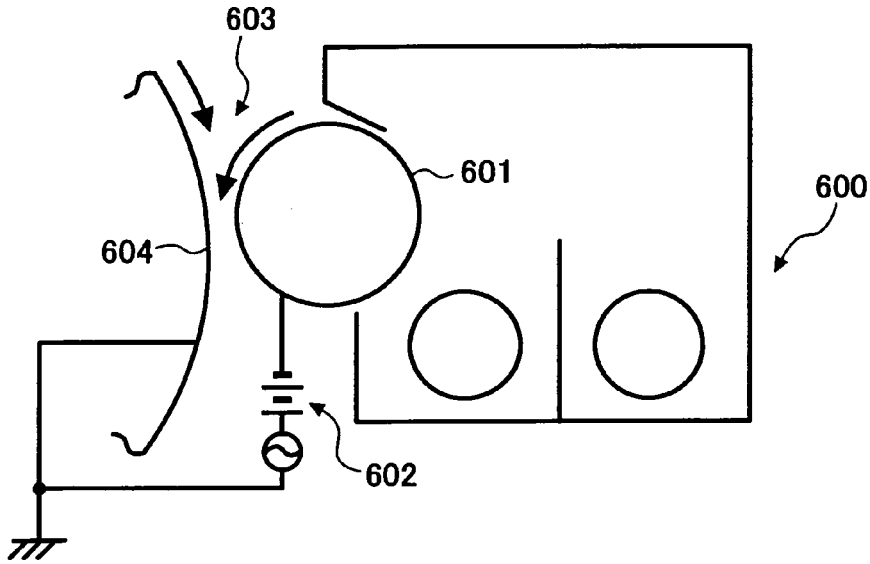
FIG. 3 is a schematic view illustrating an embodiment of an alternate electric filed applicator for development for use in the present invention.

FIG. 3 is a schematic view illustrating an embodiment of an alternate electric filed applicator for development for use in the present invention.

In an image developer 600 in FIG. 3, a vibration bias voltage, which is a DC voltage overlapped with an AC voltage, is applied to a developing sleeve 601 from an electric source 602 as a developing bias when developing an image. The background potential and image potential are located between a maximum and a minimum of the vibration bias potential. An alternate electric field, changing the direction alternately, is formed at a developing portion 603. In the alternate electric field, the toner and carrier intensely vibrate, and the toner flies to a photoreceptor drum 604, being released from an electrostatic binding force of the developing sleeve 601, and the carrier and toner are transferred to a latent image on the photoreceptor drum 604.

A difference between the maximum and minimum of the vibration bias voltage (voltage between the peaks) is preferably from 0.5 to 5 KV, and the frequency thereof is preferably from 1 to 10 KHz. The vibration bias voltage can have the waveform of a rectangular wave, a sine curve or a triangular wave. The DC voltage of the vibration bias is a value between the background potential and image potential as mentioned above, and is preferably closer to the background potential than to the image potential to prevent the toner from adhering to the background.

When the vibration bias voltage has the waveform of a rectangular wave, the duty ratio is preferably not greater than 50%. The duty ratio is a time ratio relating the time during which the toner is headed for the photoreceptor to one cycle of the vibration bias. A difference between the peak value and time average of the bias orienting the toner to the photoreceptor can be large, and therefore the toner moves more actively and faithfully adheres to the latent image to decrease roughness and improve image resolution of the toner image. In addition, the difference between the peak value and time average of the bias orienting the carrier to the photoreceptor can be small, and therefore the carrier becomes inactive and probability of the carrier adherence to the background of the latent image can largely be decreased.

It is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The transferer may be one, or two or more, and includes a corona transferer using a corona discharge, a transfer belt, a transfer roller, a pressure transfer roller, an adhesive roller, etc. The recording medium is not particularly limited, and can be selected from known recording media (recording papers).

The visible image transferred onto the recording medium is fixed thereon by a fixer. Each color toner image or the resultant complex full-color image may be fixed thereon. The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc. The heating temperature is preferably from 80 to 200° C.

In the present invention, a known optical fixer may be used with or instead of the fixer in accordance with the purpose.

The fixer of the present invention preferably includes a heater equipped with a heating element, a film contacting the heater and pressurizer contacting the heater through the film, wherein a recording material an unfixed image is formed on passes through between the film and pressurizer to fix the unfixed image upon application of heat.

Figure 4:
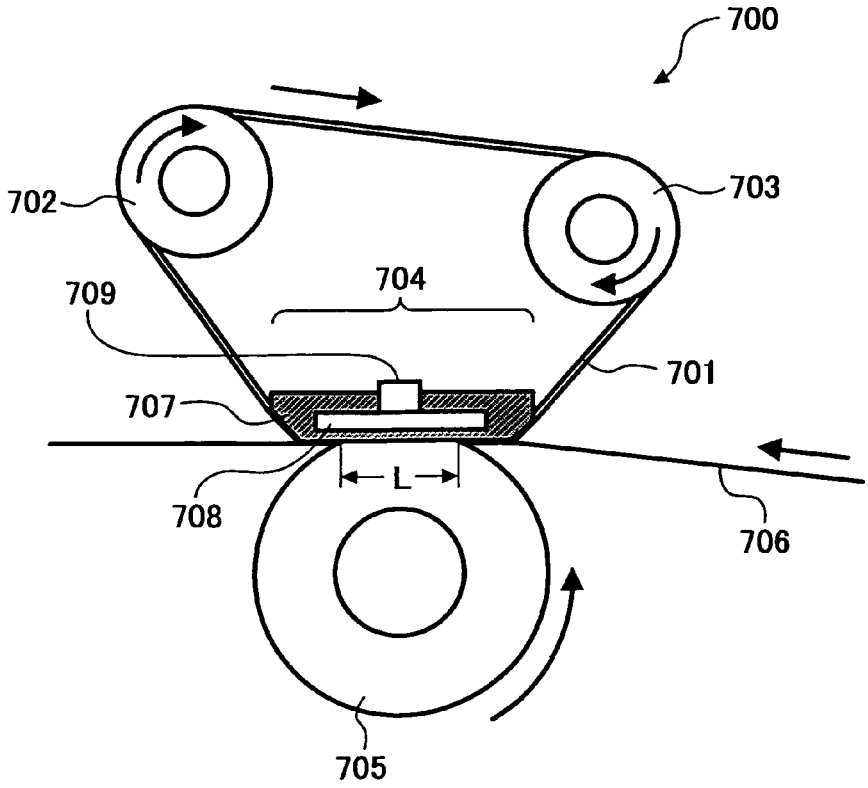
FIG. 4 is a schematic view illustrating an embodiment of a fixer for use in the present invention.

FIG. 4 is a schematic view illustrating an embodiment of a fixer for use in the present invention. The fixer is a surf fixer 700 rotating a fixing film as shown therein. The fixing film 701 is a heat resistant film having the shape of an endless belt, which is suspended and strained among a driving roller 702, a driven roller 703 and a heater 704 located there between underneath.

The driven roller 703 is a tension roller as well, and the fixing film 701 rotates clockwise according to a clockwise rotation of the driving roller 702 in FIG. 4. The rotational speed thereof is equivalent to that of a transfer material 706 at a fixing nip area L where a pressure roller 705 and the fixing film 701 contact each other.

The pressure roller 705 has a rubber elastic layer having good releasability such as silicone rubbers, and rotates counterclockwise while contacting the fixing nip area L at a total pressure of from 4 to 10 kg.

The fixing film 701 preferably has a good heat resistance, releasability and durability, and has a total thickness not greater than 100 μm, and preferably not greater than 40 μm. Specific examples of the fixing film include films formed of a single-layered or a multi-layered film of heat resistant resins such as polyimide, polyetherimide, polyethersulfide (PES) and a tetrafluoroethyleneperfluoroalkylvinylethe copolymer resin (PFA) having a thickness of 20 μm, on which (contacting an image) a release layer including a fluorocarbon resin such as a tetrafluoroethylene resin (PTFE) and a PFA and an electroconductive material and having a thickness of 10 μm or an elastic layer formed of a rubber such as a fluorocarbon rubber and a silicone rubber is coated.

In FIG. 4, the heater 704 is formed of a flat substrate 707 and a fixing heater 708, and the flat substrate 707 is formed of a material having a high heat conductivity and a high resistivity such as alumina. The fixing heater 708 formed of a resistance heater is located on a surface of the heater contacting the fixing film 701 in the longitudinal direction of the heater. An electric resistant material such as Ag/Pd and $Ta_2N$ is linearly or zonally coated on the fixing heater 708 by a screen printing method, etc. Both ends of the fixing heater have electrodes (not shown) and the resistant heater generates a heat when electricity passes though the electrodes. Further, a fixing temperature sensor 709 formed of a thermistor is located on the other side of the substrate opposite to the side on which the fixing heater 708 is located.

Temperature information of the substrate detected by the fixing temperature sensor 709 is transmitted to a controller controlling an electric energy provided to the fixing heater to make the heater 704 have a predetermined temperature.

The fixer has good heat efficiency and a warm-up time thereof can be shortened.

The electrostatic latent image bearer is discharged by the discharger upon application of discharge bias. The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by the cleaner. The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and web cleaner.

In the present invention, the cleaner preferably includes two blades, i.e., a first cleaning blade and a second cleaning blade from an upstream of the rotation direction of the electrostatic latent image bearer, and the second cleaning blade preferably includes a host layer thereof and a layer including a particulate abrasive.

Figure 5:
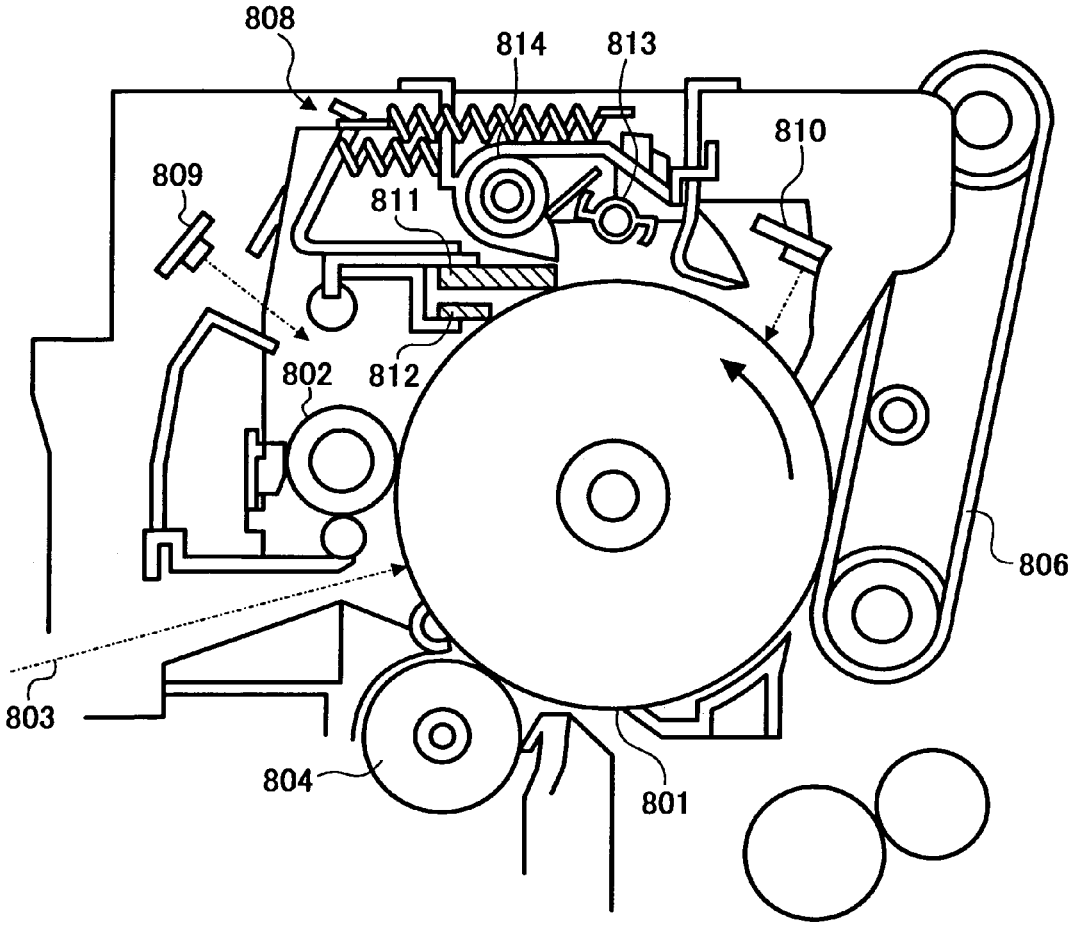
FIG. 5 is a schematic view illustrating a preferred embodiment of a cleaner for use in the present invention.

FIG. 5 is a schematic view illustrating a preferred embodiment of a cleaner for use in the present invention. Around a photoreceptor 801, i.e., an image bearer, a charging roller 802 uniformly charging the photoreceptor 801, an irradiator 803 forming an electrostatic latent image thereon, an image developer 804 developing the electrostatic latent image to form a toner image, a transfer belt 806 transferring the toner image onto a recording paper, a cleaner 808 cleaning the photoreceptor after the toner image in transferred and a discharge lamp 809 are located close or contacting to the photoreceptor 801.

Figure 6:
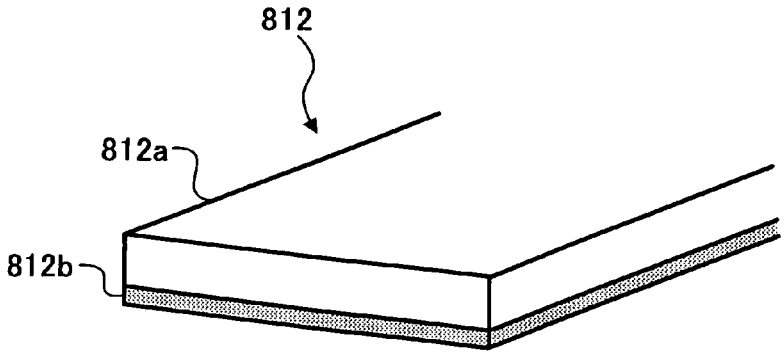
FIG. 6 is a schematic view illustrating an embodiment of a layer composition of a second cleaning blade in FIG. 5.

The cleaner 808 includes two blades, i.e., a first cleaning blade 811 and a second cleaning blade 812 from an upstream of the rotation direction of the photoreceptor 801. In addition, the cleaner 808 includes a toner collection blade 813 collecting the toner removed and a collection coil 814 transporting the toner. The first cleaning blade 811 is formed of a material such as metals, resins and rubbers. Fluorocarbon rubbers, silicone rubbers, butyl rubbers, butadiene rubbers, isoprene rubbers, urethane rubbers are preferably used, and among which the urethane rubbers are most preferably used. The second cleaning blade 812 is, as shown in FIG. 6, an abrading blade formed of two layers including a host layer 812*a* and a layer including a particulate abrasive 812*b*. The host layer 812*a* is formed of a material such as metals, resins and rubbers. Similarly to the first cleaning blade, rubbers, particularly urethane rubbers are preferably used. The layer including a particulate abrasive 812*b* is formed of a rubber wherein a particulate abrasive is dispersed. The rubbers used for the host layer 812*a* and the layer including a particulate abrasive 812*b* preferably have a hardness of from 65° to 85°. When less than 65°, the blade is quickly abraded. When greater than 85°, an edge of the blade is liable to get chipped.

The particulate abrasive includes nitrides such as silicon nitride; silicates such as aluminum silicate, magnesium silicate, mica and calcium silicate; calcareous materials such as calcium sulfate; carbides such as silicon carbide, boron carbide, tantalum carbide, titanium carbide, aluminum carbide and zirconium carbide; and oxides such as cerium oxide, chrome oxide, titanium oxide and aluminum oxide. Among these particulate abrasives, the cerium oxide is preferably used.

The particulate abrasive preferably has an average particle diameter of from 0.05 to 100 μm. When less than 0.05 μm, the particulate abrasive is too microscopic to be uniformly dispersed in the rubber and the resultant abrasive blade does not have sufficient abrading power. When greater than 100 μm, the abrading power is so strong that the surface of the photoreceptor 801 is damaged. The layer including a particulate abrasive 812*b* preferably includes the particulate abrasive in an amount of from 0.5 to 50% by weight. When less than 0.5% by weight, the particulate abrasive is too sparsely dispersed to uniformly abrade the surface of the photoreceptor 801. When greater than 50% by weight, the particulate abrasive has so high a density that the particulate abrasive is liable to fall off and the cost thereof becomes high. The host layer 812*a* and the layer including a particulate abrasive 812*b* can have a thickness as desired, however, the layer including a particulate abrasive 812*b* preferably has a thickness of from 0.5 to 50% based on total thickness of the second cleaning blade 812. When less than 0.5%, the quality thereof cannot be maintained. When greater than 50%, the elasticity thereof becomes too low to uniformly abrade the surface of the photoreceptor 801.

The second cleaning blade 812 having the above-mentioned two-layer structure contacts the abrading surface of the layer including a particulate abrasive 812*b* to the photoreceptor 801. The first cleaning blade 811 principally removes a toner remaining on the photoreceptor 801 after transferred and a paper powder thereon. The second cleaning blade 812 removes materials adhered and filmed on the photoreceptor 801, which are mostly inorganic particulate materials releasing from the toner, by scraping them away. At the same time, the second cleaning blade 812 removes the toner and the paper powder leaking from the first cleaning blade 811. Since the particulate abrasive is uniformly dispersed in the layer including a particulate abrasive 812*b* of the second cleaning blade 812, the surface of the photoreceptor 801 is uniformly abraded and free from defects.

Compared with an abrasive blade coated with an abrasive, the particulate abrasive in the layer including a particulate abrasive 812*b* is not peeled off or scraped away in a short time, and the resultant cleaner can maintain good cleanability for long periods.

Next, the relation ship between the first cleaning blade 811 and the second cleaning blade 812 will be explained.

When the first cleaning blade 811 and the host layer 812*a* of the second cleaning blade 812 are formed of rubbers, the rubber of the host layer 812*a* of the second cleaning blade 812 is preferably has a hardness higher than that of the first cleaning blade 811. This is because the second cleaning blade 812 removes materials adhered and filmed on the photoreceptor 801, which cannot be removed by the first cleaning blade 811, with a stronger abrading power.

Both of the first cleaning blade 811 and the second cleaning blade 812, as shown in FIG. 5, preferably contact the photoreceptor 801 in the counter direction of the rotation direction thereof. The first cleaning blade 811 contacting the photoreceptor 801 in the counter direction of the rotation direction thereof, the first cleaning blade 811 can efficiently remove the toner remaining after transferred and the paper powder. The second cleaning blade 812 contacting the photoreceptor 801 in the counter direction of the rotation direction thereof, and the second cleaning blade 812 can remove the materials adhered thereon with an encounter impact and have good cleanability. The second cleaning blade 812 preferably contacts the photoreceptor 801 at an angle of from 5° to 25°. When less than 5°, the second cleaning blade 812 creeps on the photoreceptor 801 and cannot abrade the surface thereof as time passes. When greater than 25°, the blade works up when the photoreceptor 801 reverses at the time of finishing a job. The second cleaning blade 812 preferably contacts the photoreceptor 801 at a pressure of from 10 gf/cm to 60 gf/cm. When less than 10 gf/cm, the materials adhered thereon easily scrape through the second cleaning blade 812 and cannot sufficiently be removed. When greater than gf/cm, the photoreceptor 801 is abraded too much to have a long life. The second cleaning blade 812 preferably contacts the photoreceptor 801 at a pressure depth of from 0.2 to 1.5 mm, which relates to the hardness of the second cleaning blade 812 and contact pressure thereof to the photoreceptor 801. The second cleaning blade 812 being located to have such a pressure depth sufficiently removes the materials adhered on the photoreceptor 801 without abrading the photoreceptor 801 too much.

Figure 7:
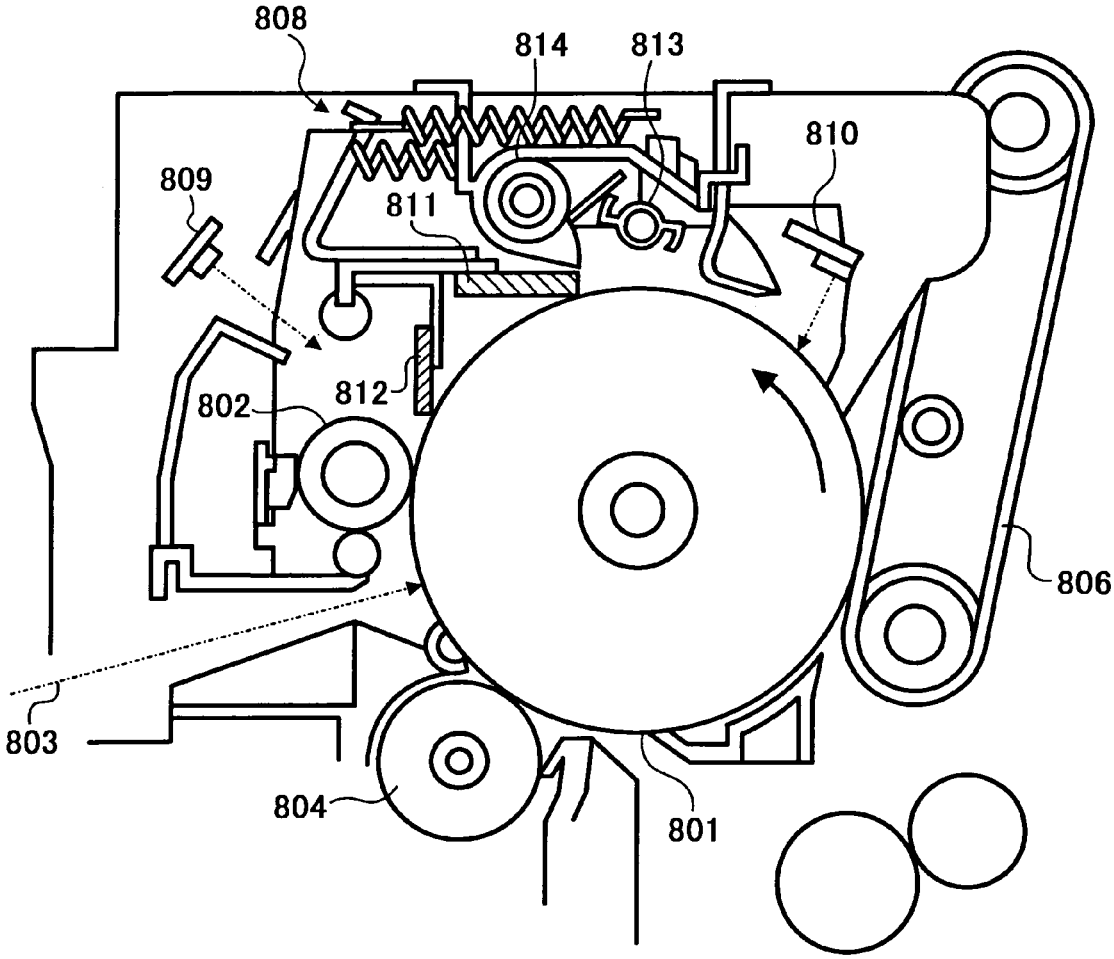
FIG. 7 is a schematic view illustrating another embodiment of a cleaner for use in the present invention.

FIG. 7 is a schematic view illustrating another embodiment of a cleaner for use in the present invention. As shown therein, the first cleaning blade 811 contacts the photoreceptor 801 in the counter direction of the rotation direction thereof, and the second cleaning blade 812 may contact the photoreceptor 801 in the trailing direction of the rotation direction thereof. The first cleaning blade 811 contacts the photoreceptor 801 in the counter direction of the rotation direction thereof because of the same reason mentioned above. The capability of removing the adhered materials of the second cleaning blade 812 contacting the photoreceptor 801 in the trailing direction of the rotation direction thereof becomes slightly lower than the second cleaning blade 812 contacting the photoreceptor 801 in the counter direction of the rotation direction thereof. However, the second cleaning blade 812 scarcely receiving a pressure of the toner is liable to get chipped, but the contact in the trailing direction can avoid this. The second cleaning blade 812 preferably contacts the photoreceptor 801 at a pressure of from 10 gf/cm to 60 gf/cm to perform good cleaning, because of the same reason of the second cleaning blade 812 contacting the photoreceptor 801 in the counter direction of the rotation direction thereof.

In the cleaners in FIGS. 5 and 7, the second cleaning blades 812 may constantly or intermittently contact the photoreceptor 801. In this case, the second cleaning blade 812 needs to have a divider such as a solenoid and a cam. The second cleaning blade 812 intermittently contacting the photoreceptor 801 can reduce an abraded amount thereof and extend a life thereof.

Figure 8:
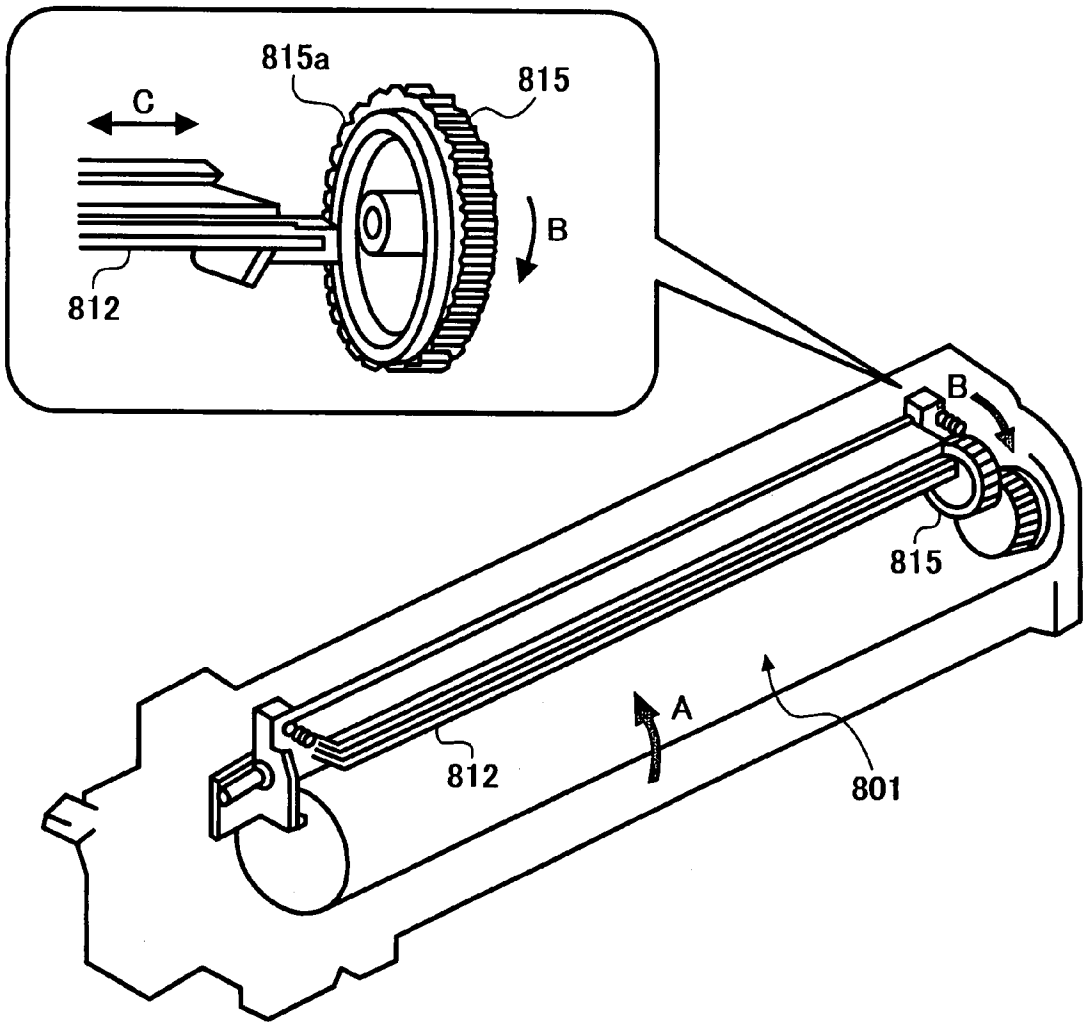
FIG. 8 is a schematic view illustrating an embodiment of an oscillating mechanism of a second cleaning blade in FIG. 7.

Further, the second cleaning blade 812 preferably has an oscillating mechanism. FIG. 8 is a schematic view illustrating an embodiment of an oscillating mechanism of the second cleaning blade. The second cleaning blade 812 is supported by a pressure holder (not shown) and pressed against a cam face 815*a* of a gear having an oscillating cam 815. When the photoreceptor 801 rotates in the direction indicated by an arrow A, the gear having an oscillating cam 815 rotates in the direction indicated by an arrow B, and in accordance with this, the second cleaning blade 812 oscillates in the direction indicated by an arrow C. The second cleaning blade 812 having the oscillating mechanism can uniformly abrade the photoreceptor 801 even when an abrasive is more or less disproportionately dispersed in the layer including a particulate abrasive 812*b*. Although the first cleaning blade 811 does not include an abrasive, the first cleaning blade 811 slightly abrades the photoreceptor 801, and therefore the first cleaning blade 811 is preferably oscillated together with the second cleaning blade 812 by the same oscillating mechanism. Further, the first cleaning blade 811 and the second cleaning blade 812 are preferably oscillated in different phases to more uniformly abrade the photoreceptor 801. The first cleaning blade 811 and the second cleaning blade 812 are oscillated in different phases when the cam face 815*a* of the gear having an oscillating cam 815 has another cam face having a different phase inside.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

Figure 9:
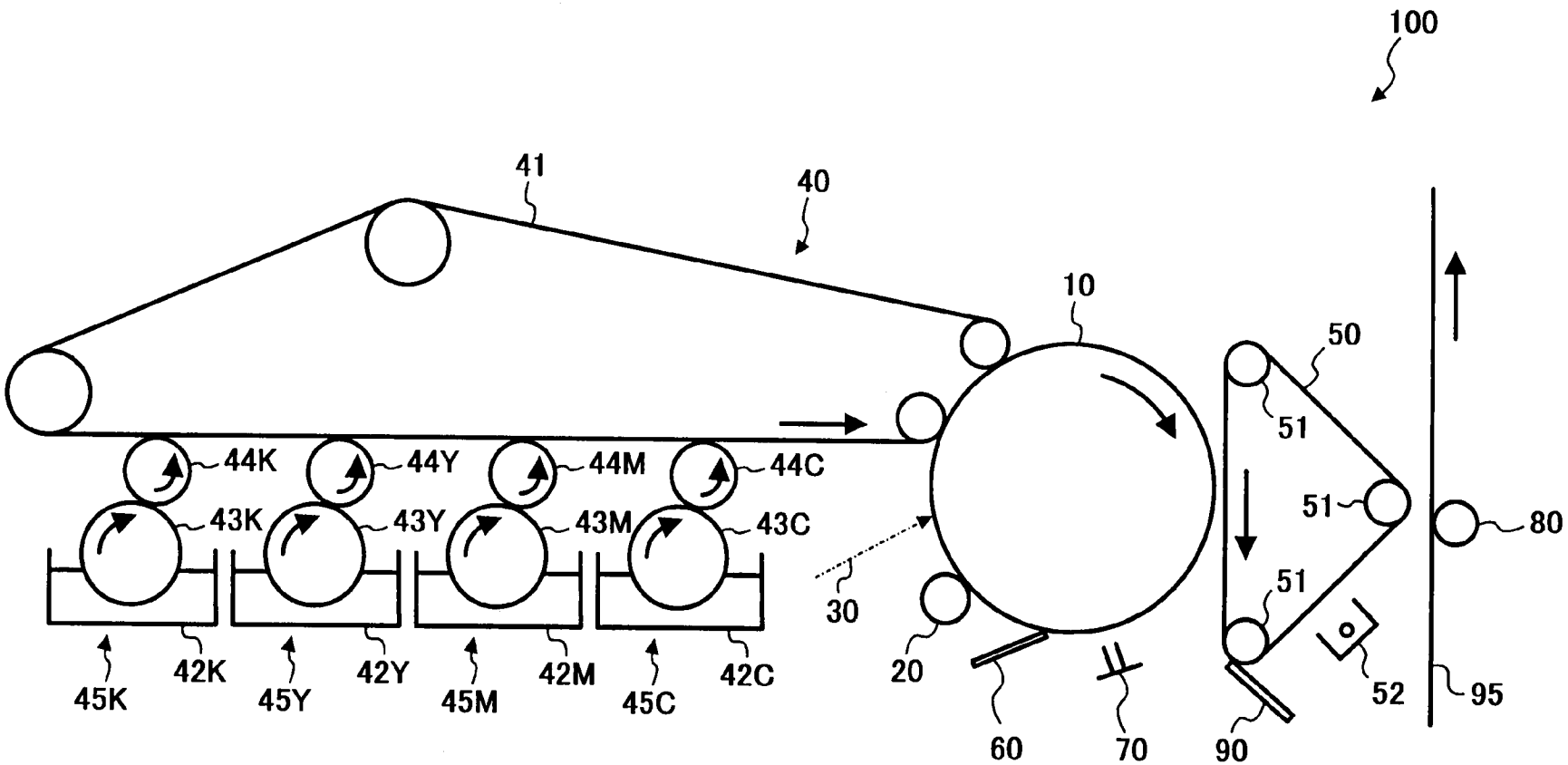
FIG. 9 is a schematic view illustrating an embodiment of an image forming apparatus for explaining the image forming method of the present invention.

FIG. 9 is a schematic view illustrating an embodiment of an image forming apparatus for explaining the image forming method of the present invention.

In the image forming apparatus 100 therein, around a photoreceptor drum (hereinafter referred to as a photoreceptor) as an image bearer 10, a charging roller as a charger 20, an irradiator 30, a cleaner having a cleaning blade 60, a discharge lamp as a discharger 70, an image developer 40 and a intermediate transferer 50 are arranged.

The intermediate transferer 50 is suspended by plural suspension rollers 51 and endlessly driven by a driver such as motor (not shown) in a direction indicated by an arrow. Some of the suspension rollers 51 are combined with roles of transfer bias rollers feeding a transfer bias to the intermediate transferer and a predetermined transfer bias is applied thereto from an electric source (not shown). A cleaner having a cleaning blade 90 cleaning the intermediate transferer 50 is also arranged. A transfer roller 80 transferring a toner image onto a transfer paper 95 as a final transferer is arranged facing the intermediate transferer 50, to which a transfer bias is applied from an electric source (not shown). Around the intermediate transferer 50, a corona charger 58 is arranged as a charger.

The image developer 40 includes a developing belt 41 as a developer bearer, a black developing unit 45K, a yellow developing unit 45Y, a magenta developing unit 45M and a cyan developing unit 45C around the developing belt 41. The developing belt 41 is extended over plural belt rollers, endlessly driven by a driver such as motor (not shown) in a direction indicated by an arrow and driven at almost a same speed as the photoreceptor 10 at a contact point therewith.

In FIG. 9, after the photoreceptor 10 is uniformly charged rotating in a direction indicated by an arrow, the irradiator 30 irradiates the photoreceptor 10 with an original imagewise light from an optical system (not shown) to form an electrostatic latent image thereon. The electrostatic latent image is developed by the image developer 40 to form a visual toner image thereon. The developer thin layer on the developing belt 41 is released therefrom as it is and transferred onto a part the electrostatic latent image is formed on. The toner image developed by the image developer 40 is transferred onto the surface of the intermediate transferer 50 (first transfer) driven at a same speed as that of the photoreceptor 10 at a contact point (first transfer area) therewith. When 3 or 4 colors are overlaid on the intermediate transferer 50 to form a full-color image thereon.

In the rotating direction of the intermediate transferer 50, the corona charger 52 charging the toner image thereon is located in a downstream of the contact point between the photoreceptor 10 and the intermediate transferer 50, and in an upstream of a contact point between the intermediate transferer 50 and the transfer paper 95. The corona charger 52 applies a sufficient charge having a same polarity as that of the toner particle to the toner image so as to be transferred well onto the transfer paper 95. After the toner image is charged by the corona charger 52, the toner image is transferred at a time by a transfer bias from the transfer roller 80 onto the transfer paper 95 fed from a paper feeder (not shown) in a direction indicated by an arrow. Then, the transfer paper 100 the toner image is transferred onto is separated from the photoreceptor 10 by a separator (not shown). After the toner image is fixed thereon by a fixer (not shown), the transfer paper 95 is discharged from the copier. On the other hand, untransferred toner is removed from the photoreceptor 10 by a cleaner 60 after the toner image is transferred, and discharged by the discharge lamp 70 to be ready for the following charge.

Figure 10:
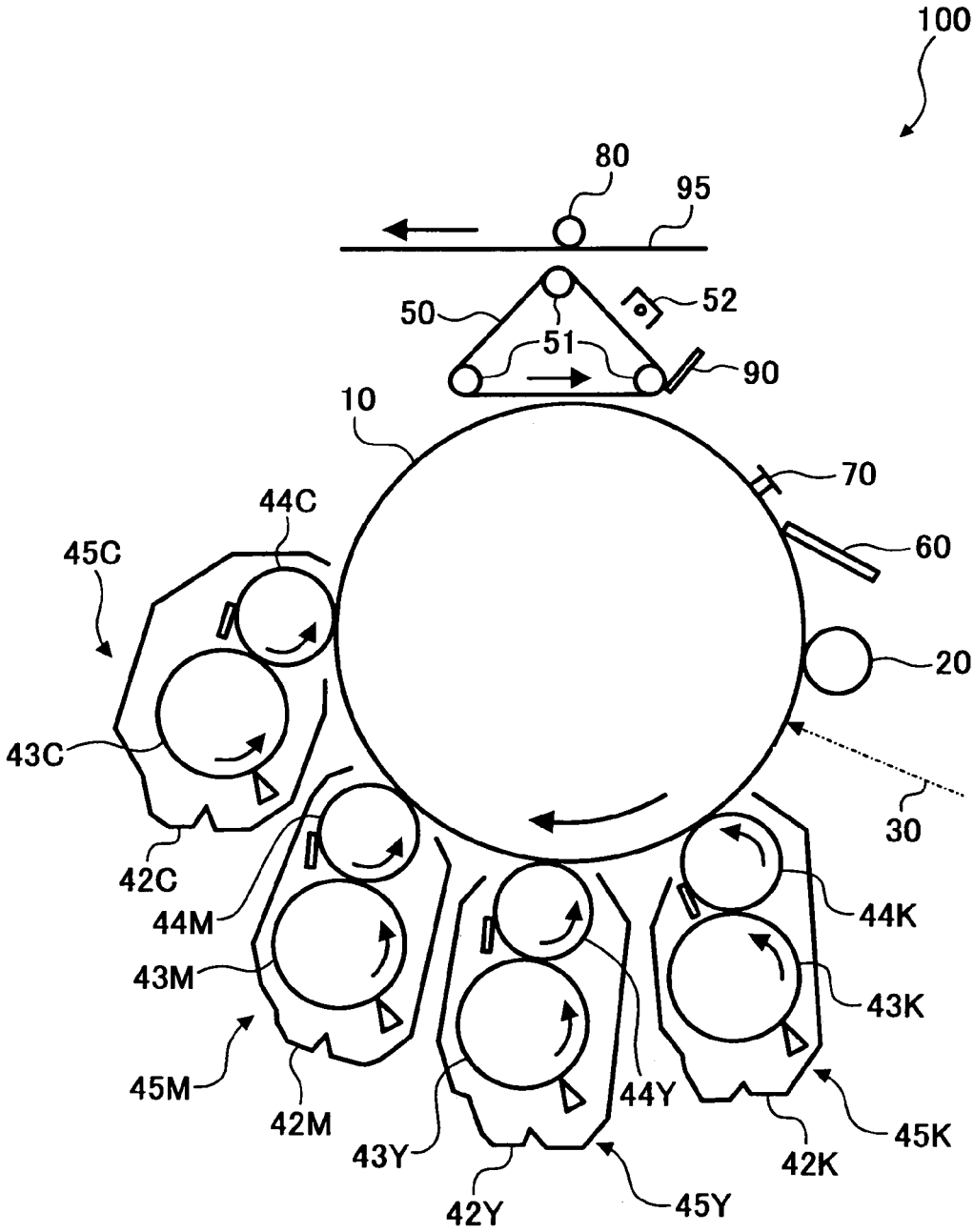
FIG. 10 is a schematic view illustrating another embodiment of an image forming apparatus for explaining the image forming method of the present invention.

In the present invention, besides the embodiment of a full-color copier in FIG. 9, an embodiment of a full-color copier in FIG. 10 wherein developing units 45 for each color are located around a photoreceptor 10 can be used.

Figure 11:
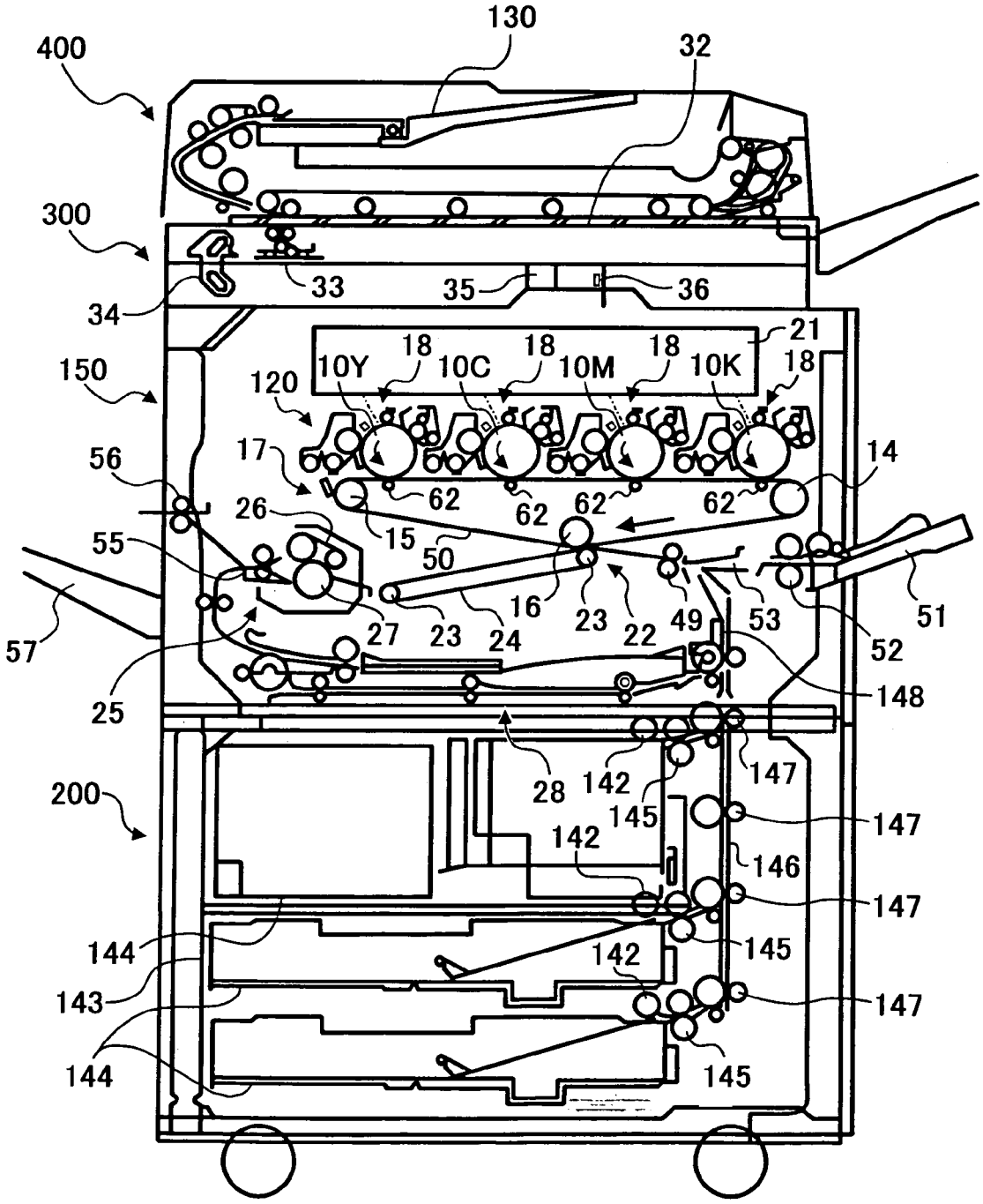
FIG. 11 is a schematic view illustrating another embodiment of an image forming apparatus (tandem color image forming apparatus) for explaining the image forming method of the present invention.

FIG. 11 is a schematic view illustrating another embodiment of an image forming apparatus (tandem color image forming apparatus) for explaining the image forming method of the present invention.

Numeral 120 is the tandem color image forming apparatus, 200 is a paper feeding table, 300 is a scanner on the copier 100 and 400 is an automatic document feeder (ADF) on the scanner 300. The tandem color image forming apparatus 120 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form the tandem image forming apparatus 120. Above the tandem color image forming apparatus 120, an irradiator 21 is located. On the opposite side of the tandem color image forming apparatus 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes an endless belt 26 and a pressure roller 27 pressed against the belt. The second transferer 22 also includes a function of transporting the sheet an image is transferred on to the fixer 25. As the second transferer 22, a transfer roller and a non-contact charger may be used. However, they are difficult have such a function of transporting the sheet.

In FIG. 11, below the second transferer 22 and the fixer 25, a sheet reverser 28 reversing the sheet to form an image on both sides thereof is located in parallel with the tandem color image forming apparatus 120.

An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred onto the intermediate transferer 50 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feed the sheet into a paper feeding route 53 to be stopped against a resist roller 49.

Then, in timing with a synthesized full-color image on the intermediate transferer 50, the resist roller 49 is rotated to feed the sheet between the intermediate transferer 50 and the second transferer 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 50 after transferring an image is cleaned by the intermediate transferer cleaner 17 to remove a residual toner thereon after the image is transferred, and ready for another image formation by the tandem color image forming apparatus 120.

The resist roller 49 is typically earthed, and a bias may be applied thereto remove paper dust from the sheet.

Figure 12:
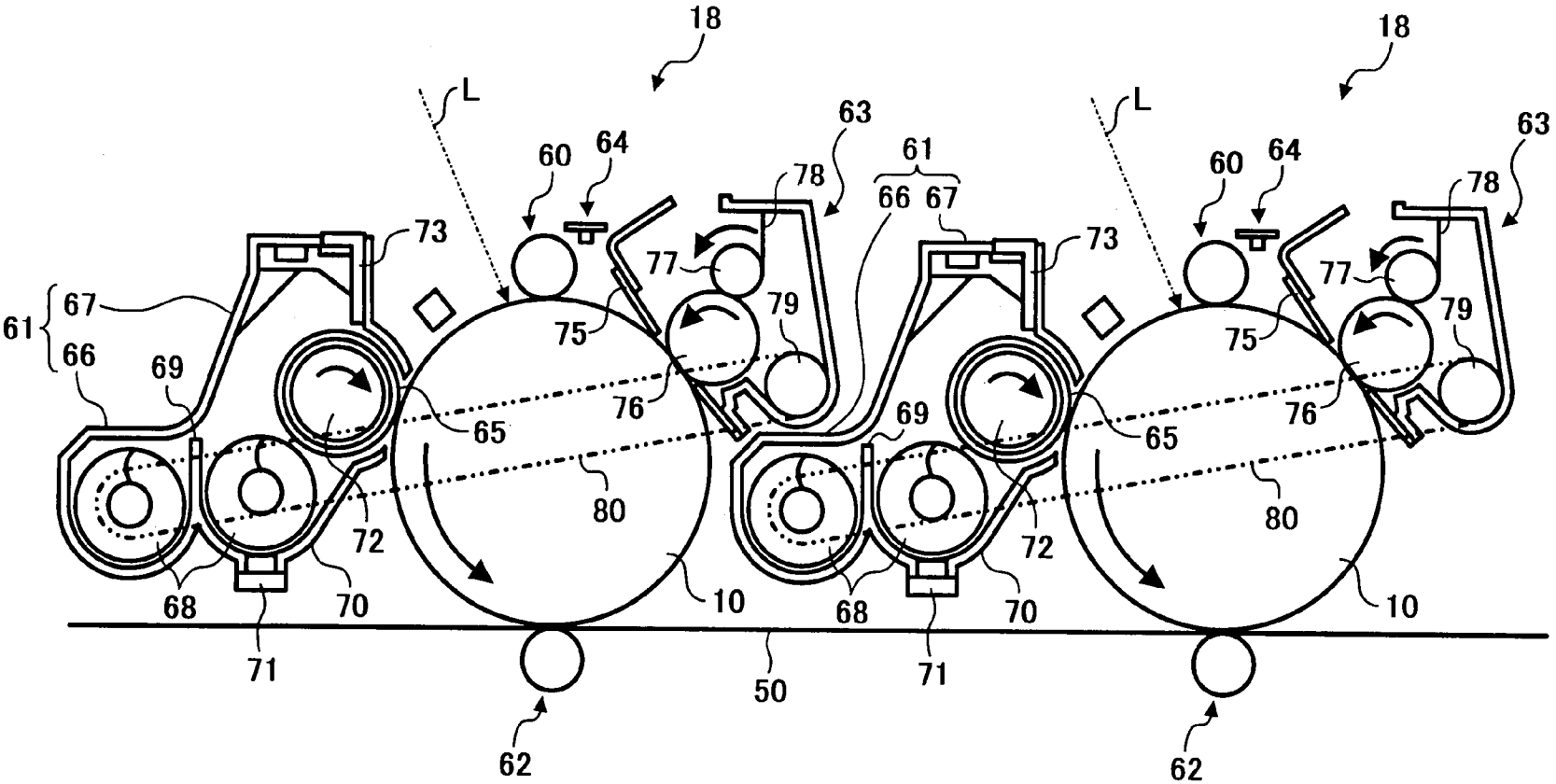
FIG. 12 is a partially enlarged schematic view illustrating a developing unit of the image forming apparatus in FIG. 11.

In the tandem color image forming apparatus 120, each of the image forming units 18 includes, as shown in FIG. 12, a charger 60, an image developer 61, a first transferer 62, a photoreceptor cleaner 63 and a discharger 64 around a drum-shaped photoreceptor 10.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES (Preparation of Toner)

Preparation Example 1

64 parts of ester wax were added into a monomer mixture including 108 parts of styrene, 39 parts of n-butylacrylate, 9.6 parts of methacrylate, and the mixture was heated to have a temperature of 80° C. to dissolve the ester wax therein to prepare a monomer solution. On the other hand, a surfactant solution (an aqueous medium) wherein 7.0 parts of sodium dodecylbenzenesulfonate were dissolved in 2,400 parts of ion-exchange water was put in a separable flask having a capacity of 3.0 L, a stirrer, a temperature sensor, a cooling pipe and a nitrogen introducer. The surfactant solution was heated to have a temperature of 80° C. while stirred at 360 rpm. The monomer solution (80° C.) was mixed and dispersed in the surfactant solution (80° C.) in the separable flask by a mechanical disperser having a circulating route to prepare a dispersion including emulsified particles (oil droplets) having a uniform dispersed particle diameter. A polymerization initiator wherein 0.8 parts of potassium peroxodisulfate were dissolved in 200 parts of ion-exchange water was added into the dispersion, and which was heated and stirred at 80° C. for 3 hrs to be polymerized (a first stage polymerization) to prepare a [particulate polymerized material solution 1].

A polymerization initiator wherein 7.7 parts of potassium peroxodisulfate were dissolved in 240 parts of ion-exchange water was added into the [particulate polymerized material solution 1]. After this was fully stirred, a monomer mixture including 380 parts of styrene, 137.5 parts of n-butylacrylate, 36 parts of methacrylate and 14.5 parts of t-dodecylmercaptan was dropped therein at 80° C. for 2 hrs. Then, this was heated and stirred for 60 min to be polymerized (a second stage polymerization), and cooled to have a temperature of 40° C. to prepare a [particulate polymerized material solution 2].

20 parts of a carbon black (#25B from Mitsubishi Chemical Corporation) were gradually added into an aqueous solution wherein 9.6 parts of n-dodecyl sodium sulfate were dissolved in 160 parts of ion-exchange water while stirred. Then, this was dispersed by T.K. HOMOMIXER from TOKUSHU KIKA KOGYO CO., LTD. with a high shearing force to prepare a [colorant dispersion].

1,200 parts of the [particulate polymerized material solution 2], 2,000 parts of ion-exchange water and the [colorant dispersion] were put in a four-orifice flask having a capacity of 5 L, a stirrer, a temperature sensor, a cooling pipe and a nitrogen introducer, and this was stirred.

After the resultant liquid was controlled to have a temperature of 30° C., a sodium hydroxide solution having a concentration of 5N was added therein to have a pH of 10.0. Then, an aqueous solution wherein 52.5 parts of magnesium chloride hexahydrate were dissolved in 72 parts of ion-exchange water was added therein at 30° C. for 10 min while stirred. After left for 5 min, this was heated to have a temperature of 90° C. for 10 min at a heating speed of 10° C./min. Then, a particle diameter of associated particles was measured by a Coulter Counter TA-II, and when a volume-average particle diameter thereof became 6.0 μm, an aqueous solution wherein 115 parts of sodium chloride were dissolved in 700 parts of ion-exchange water was added therein to stop growth of the particles. Further, the resultant liquid was maintained to have a temperature of 90±2° C. and stirred for 6 hrs to continue fusion bonding. Then, this was cooled to have temperature of 30° C. at 6° C./min. The resultant dispersion of the associated particles was washed with a sulfuric acid at 25° C. for 10 min to have a ph not greater than 4 while stirred. After this was filtered to separate water therefrom, 500 parts of ion-exchange water was added therein to wash this therewith. Then, after the dehydration and aqueous cleaning were repeated for several times to filter and separate a sold content therefrom, this was dried at 45° C. for 24 hrs to prepare [polymerized particles (toner) 1]. The [polymerized particles (toner) 1] has a Dv of 6.0 μm and Dv/Dn of 1.23.

Preparation Example 2

12 parts of styrene, 7 parts of a carbon black (#25B from Mitsubishi Chemical Corporation) and 1 part of a charge controlling agent (SPIRON BLACK TRH from Hodogaya Chemical Co., Ltd.) were mixed and dispersed by a sand mill from Kansai Paint Co., Ltd. for 12 hrs to prepare a mixture. 60 parts of styrene, 18 parts of n-butylacrylate, 3 parts of methacrylate, 0.3 parts of divinylbenzene, 0.6 parts of t-dodecylmercaptan, 10 parts of pentaerythritol tetrastearate having a purity of 60% of stearate and 6 parts of ester wax were mixed, stirred and uniformly dispersed by T.K. HOMOMIXER from TOKUSHU KIKA KOGYO CO., LTD. with a high shearing force at 11,000 rpm to prepare a [polymerizing monomer constituents (mixture) for core].

5 parts of methylmethacrylate and 100 parts of water were finely dispersed by an ultrasonic emulsifier from TOKUSHU KIKA KOGYO CO., LTD. to prepare a [polymerizing monomer aqueous dispersion for shell].

An aqueous solution wherein 7 parts of sodium hydroxide were dissolved in 50 parts of ion-exchange water was gradually added into an aqueous solution wherein 10 parts of magnesium chloride were dissolved in 250 parts of ion-exchange water while stirred to prepare an [aqueous dispersion medium]

After the [polymerizing monomer constituents (mixture) for core] was put and mixed in the [aqueous dispersion medium] to prepare a mixture, 4 parts of t-buylperocy-2-ethylhexanoate were added therein and the mixture was stirred by T.K. HOMOMIXER from TOKUSHU KIKA KOGYO CO., LTD. with a high shearing force at 11,000 rpm to granulate droplets of the [polymerizing monomer constituents for core]. The granulated aqueous dispersion of the monomer constituents was put in a polymerization reactor having a stirrer, wherein the monomer constituents were polymerized to prepare a polymerized dispersion, and when a polymerization rate reached almost 100%, the [polymerizing monomer aqueous dispersion for shell] and 1 part of an aqueous solution including potassium peroxodisulfate in an amount of 1% by weight were added therein and the reaction was continued for 5 hrs to prepare an aqueous dispersion of core-shell polymerized particles. The resultant aqueous dispersion of core-shell polymerized particles was washed with a sulfuric acid at 25° C. for 10 min to have a ph not greater than 4 while stirred. After this was filtered to separate water therefrom, 500 parts of ion-exchange water was added therein to wash this therewith. Then, after the dehydration and aqueous cleaning were repeated for several times to filter and separate a sold content therefrom, this was dried at 45° C. for 24 hrs to prepare [polymerized particles (toner) 2]. The [polymerized particles (toner) 2] has a Dv of 6.2 μm and Dv/Dn of 1.22.

Preparation Example 3

2,000 parts of methanol and 100 parts of polyvinylpyrrolidone were put in a closable reactor vessel rotating in a water tank having a constant temperature to prepare a mixture, and which was stirred for about 1 hr at a normal temperature to prepare a [hydrophilic organic liquid]. Then, the polyvinylpyrrolidone was completely dissolved.

53 parts of styrene, 43 parts of methylacrylate, 3 parts of methacrylate, 3.0 parts of 1,3-butandioldimethacrylate and 0.5 parts of t-dodecylmercaptan were added into 250 parts of methanol solution wherein a dispersion stabilizer was dispersed in a closable reactor vessel rotating in a water tank having a constant temperature. The reactor vessel was rotated to mix the mixture and a $N_2$ gas was blown therein to completely let the air out thereof to close the reactor vessel.

After the reactor vessel was rotated in the water tank at 60° C. and 100 rpm for 1 hr, 1.0 part of 2,2'-azobisisobutylnitrile was added therein while a $N_2$ gas was blown therein to close the reactor vessel, and the reactor vessel was further rotated in the water tank at 60° C. and 100 rpm for 6 hrs. Further, 8 parts of methanol, 1.5 parts of 1,3-butandioldimethacrylate and 0.25 parts of t-dodecylmercaptan were added therein while a $N_2$ gas was blown therein to close the reactor vessel, and the reactor vessel was further rotated in the water tank at 60° C. and 100 rpm for 18 hrs to prepare a [polymerized dispersion].

After 30.0 parts of OIL BLACK 860 was heated and dissolved in 20 parts of methanol, the solution was cooled and filtered with a microfilter having an opening of 1 μm to prepare 10 parts of a [OIL BLACK solution].

10 parts of the [OIL BLACK solution] was added to 135 parts of the [polymerized dispersion] to prepare a mixture, and the mixture was stirred at 50° C. for 1 hr. Then, the resultant dispersion was cooled to have a room temperature, spun down to remove a supernatant liquid, and the resultant precipitate was dispersed in a mixed solvent including 50 parts of methanol and 50 parts of water for 3 times. The resultant dispersion was filtered and air-dried, and dried under reduced pressure at 40° C. for 6 hrs to prepare a [colored particulate resin] colored by the OIL BLACK 860.

After 100 parts of the [colored particulate resin] and 0.5 parts of SPIRON BLACK TRH from Hodogaya Chemical Co., Ltd. were stirred by HENSCHEL MIXER from Mitsui Mining Co., Ltd. for 5 min, the mixture was surface-treated by hybridization NHS-1 from NARA MACHINERY CO., LTD. at 7,000 rpm for 5 min to prepare [polymerized particles (toner) 3]. The [polymerized particles (toner) 3] has a Dv of 6.2 μm and Dv/Dn of 1.02.

Example 1

The [polymerized particles (toner) 1] was put in a pressure-resistant container and subjected to the following treatment using carbon dioxide as a supercritical fluid. The [polymerized particles (toner) 1] was heated and pressurized to have a temperature of 40° C. and 7.09 Mpa at 2 to 3° C./min and 0.2 MPa/min from a normal temperature and 0.1 MPa. Then, the fluid delivery rate was controlled to be 5.0 L/min, and the [polymerized particles (toner) 1] was heated and pressurized to be in a supercritical state having a temperature of 70° C. and 40.52 Mpa at 2 to 3° C./min and 10 MPa/min. The fluid delivery rate was maintained at 5.0 L/min for 6 hrs. Then, the fluid delivery rate was reduced to 1.0 to 3.0 L/min, and the [polymerized particles (toner) 1] was cooled and depressurized at 2 to 3° C./min and 3 to 5 MPa/min to have a normal temperature and 0.10 MPa.

An unsaturated carboxylic acid derivative monomer is removed from the thus prepared toner, and the toner does not need drying and washing. After an unsaturated carboxylic acid derivative monomer is removed from a toner, the pressure-resistant container including a supercritical fluid is just depressurized to deaerate carbon dioxide. Therefore, toner particles can be efficiently prepared in quite a short time, and no need for waste liquid treatment, which reduces environmental burdens.

0.8 parts of hydrophobized silica RX200 from NIPPON AEROSIL CO., LTD., having an average particle diameter of 12 nm were added to 100 parts of the resultant polymer (toner particles) to be surface-treated to prepare a [developer 1].

Example 2

The procedure for preparation of the developer 1 in Example 1 was repeated to prepare a [developer 2] except for replacing the [polymerized particles (toner) 1] with the [polymerized particles (toner) 2].

Example 3

The procedure for preparation of the developer 1 in Example 1 was repeated to prepare a [developer 3] except for replacing the [polymerized particles (toner) 1] with the [polymerized particles (toner) 3].

Comparative Example 1

The procedure for preparation of the developer 1 in Example 1 was repeated to prepare a [developer 4] except for not removing the unsaturated carboxylic acid derivative monomer with the supercritical fluid.

Comparative Example 2

The procedure for preparation of the developer 2 in Example 2 was repeated to prepare a [developer 5] except for not removing the unsaturated carboxylic acid derivative monomer with the supercritical fluid.

Comparative Example 3

The procedure for preparation of the developer 3 in Example 3 was repeated to prepare a [developer 6] except for not removing the unsaturated carboxylic acid derivative monomer with the supercritical fluid.

The following properties of the developers 1 to 6 of Examples 1 to 3 and Comparative Examples 1 to 3 respectively were evaluated.

Image density

An average image density of 5 points of each color solid image produced with each developer were measured by SPECTRODENSITOMETER 938 from X-Rite. The average image density not less than 1.4 is a practicable level.

Foggy Image

How the background of a transfer paper is contaminated with a toner is visually observed.

Transferability

◎: Very few residual toner

○: Few residual toner

Δ: Equivalent to conventional toners

X: Numerous residual toner

Durability 100,000 images were produced by a copier MF-2200 from Ricoh Company, Ltd. with each developer at a normal temperature and humidity, and subsequent charge quantity of the developer and image quality therewith were ranked to the following 4 grades.

◎: No difference with the beginning

○: Lowered in charge quantity, but not a large difference in image quality

Δ: Background fouling occurred, but practicable

X: Background fouling occurred, and not practicable

The evaluation results are shown in Table 1.

TABLE 1

| | Image density | Foggy image | Transfer-ability | Durability: Filming | Durability: charge-ability | Durability: Background fouling |
|---|---|---|---|---|---|---|
| Example 1 | 1.42 | 0.01 | ◎ | ◎ | ◎ | ◎ |
| Example 2 | 1.39 | 0.02 | ◎ | ◎ | ◎ | ◎ |
| Example 3 | 1.41 | 0.01 | ◎ | ◎ | ◎ | ○ |
| Comparative Example 1 | 1.27 | 0.59 | ○ | Δ | X | Δ |
| Comparative Example 2 | 0.79 | 0.39 | Δ | Δ | Δ | X |
| Comparative Example 3 | 1.31 | 0.31 | ○ | X | Δ | X |

As shown in Table 1, each of the toners in Examples 1 to 3, from which an unsaturated carboxylic acid derivative monomer is removed with a supercritical fluid, produces quality images and can maintain the initial image quality.

Each of the toners in Comparative Examples 1 to 3, in which an unsaturated carboxylic acid derivative monomer remains, has insufficient chargeability and fluidity, resulting in deterioration of image quality and durability.

This application claims priority and contains subject matter related to Japanese Patent Application No. 2004-177109 filed on Jun. 15, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method comprising:

contacting a polymerized toner comprising a binder resin that comprises polymerized units of at least one unsaturated carboxylic acid monomer with at least one of a supercritical fluid and a sub-critical fluid to remove unpolymerized unsaturated carboxylic acid monomer, wherein the polymerized toner has a volume-average particle diameter (Dv) of from 2 μm to 8 μm, and a ratio (Dv/Dn) of the volume-average particle diameter (Dv) to a number-average particle diameter (Dn) of not greater than 1.25.

2. The method of claim 1, wherein the unsaturated carboxylic acid monomer is an unsaturated carboxylic acid monomer of the formula:

$$H_2C{=}CR^1COOH \quad (i)$$

wherein $R^1$ represents a hydrogen atom or a hydrocarbon group having 1 to 10 carbon atoms.

3. The method of claim 1, wherein the toner further comprises polymerized units of at least one other monomer.

4. The method of claim 1, wherein the supercritical fluid and the sub-critical fluid does not dissolve the toner, and dissolves the unpolymerized unsaturated carboxylic acid monomer.

5. The method of claim 1, wherein the unpolymerized unsaturated carboxylic acid monomer is removed from a part or the whole of the toner.

6. The method of claim 1, wherein the supercritical fluid and the sub-critical fluid is an elementary substance or a mixture.

7. The method of claim 1, wherein the fluid comprises carbon dioxide.

8. The method of claim 1, wherein the fluid is separated from the unpolymerized unsaturated carboxylic acid monomer after being removed therewith to recycle the supercritical fluid.

9. The method of claim 1, wherein the fluid comprises an organic solvent.

10. The method of claim 1, wherein the toner is a particulate toner.

11. The method of claim 1, wherein the toner is prepared by a method comprising:

emulsion polymerizing or mini-emulsion polymerizing a polymerizing monomer comprising the unsaturated carboxylic acid monomer in an aqueous medium in the presence of a polymerization initiator to prepare polymerized particles;

agglomerating or fusion bonding the polymerized particles to prepare agglomerated or fusion bonded polymerized particles;

filtering the agglomerated or fusion bonded polymerized particles to prepare filtered and agglomerated or fusion bonded polymerized particles; and washing the filtered and agglomerated or fusion bonded polymerized particles.

12. The method of claim 1, wherein the toner is prepared by a method comprising:

stirring a polymerizing mixture comprising a polymerizing monomer comprising the unsaturated carboxylic acid derivative monomer and a polymerization initiator in an aqueous medium comprising a suspension stabilizer to prepare polymerized particles.

13. The method of claim 1, wherein the toner is prepared by a method comprising:

preparing a mixture comprising a hydrophilic organic liquid and a polymer dispersant dissolving therein;

adding a polymerizing monomer dissolving in the hydrophilic organic liquid into the mixture, the produced polymer of which hardly dissolves and swells in the hydrophilic organic liquid, to prepare polymerized particles.

14. The method of claim 1, wherein the unsaturated carboxylic acid monomer comprises an acrylic acid.

15. The method of claim 1, wherein the unsaturated carboxylic acid monomer comprises a methacrylic acid.

16. A toner prepared by the method according to claim 1.

17. The toner of claim 16, wherein the toner is a particulate toner.

18. A developer comprising the toner according to claim 16.

19. An image forming method comprising:

charging an image bearer;

irradiating the image bearer to form an electrostatic latent image thereon;

developing the electrostatic latent image with the developer according to claim 18 to form a toner image on the image bearer;

transferring the toner image onto an image support medium; and fixing the toner image on the image support medium.

20. The image forming method of claim 19, further comprising:

cleaning a surface of the image bearer after the transferring the toner image onto an image support medium, wherein the image bearer is an amorphous silicon photoreceptor.

21. The image forming method of claim 20, wherein the cleaning is performed with a cleaner comprising:

a first cleaning blade; and a second cleaning blade, from an upstream of the rotation direction of the electrostatic latent image bearer, wherein the second cleaning blade is an abrading blade having a two-layer structure comprising a host layer and a layer comprising a particulate abrasive.

22. The image forming method of claim 19, wherein the fixing comprises:

passing the image support medium the toner image is formed on through a fixer comprising:

a heater;

a film contacting the heater; and a pressurizer, wherein the toner image is fixed on the image support medium between the film and the pressurizer upon application of heat.

23. The image forming method of claim 19, wherein the developing the electrostatic latent image with the developer comprises applying an alternating current to the image bearer.

24. A process cartridge detachable from an image forming apparatus, comprising:

an image bearer configured to bear an electrostatic latent image; and an image developer configured to develop the electrostatic latent image with the developer according to claim 18.

25. A container containing the toner according to claim 16.

26. The method of claim 1, wherein the polymerized toner is contacted with the supercritical fluid and an optional other fluid.

27. The method of claim 26, wherein the supercritical fluid is one or more fluids selected from carbon monoxide, carbon dioxide, ammonia, nitrogen, water, methanol, ethanol, ethane, propane, 2,3-dimethylbutane, benzene, chlorotrifluoromethane, and dimethyl ether, and the optional other fluid is one or more fluids selected from nitric oxide, ethane, propane, and ethylene.

28. The method of claim 1, wherein the polymerized toner is contacted with the sub-critical fluid and an optional other fluid.

29. The method of claim 28, wherein the sub-critical fluid is one or more fluids selected from carbon monoxide, carbon dioxide, ammonia, nitrogen, water, methanol, ethanol, ethane, propane, 2,3-dimethylbutane, benzene, chlorotrifluoromethane, and dimethyl ether, and the optional other fluid is one or more fluids selected from nitric oxide, ethane, propane, and ethylene.

30. The method of claim 1, wherein the ratio (Dv/Dn) of the polymerized toner is from 1.05 to 1.25.

31. The method of claim 1, wherein the polymerized toner has a glass transition temperature (Tg) of from 30° C. to 70° C.

32. The method of claim 1, wherein the polymerized toner has a penetration of from 15 mm to 30 mm, according to JIS K2235-1991.

33. The method of claim 1, wherein the polymerized toner has a softening point (Ts) of from 50° C. to 120° C.

34. The method of claim 1, wherein the polymerized toner has a flow starting temperature (Tfb) of from 60° C. to 150° C.

35. The method of claim 1, wherein the polymerized toner has an average circularity of from 0.900 to 1.000.

* * * * *